US005610477A

United States Patent [19]

Ivanov et al.

[11] Patent Number: 5,610,477

[45] Date of Patent: Mar. 11, 1997

[54] LOW BREAKDOWN VOLTAGE GAS DISCHARGE DEVICE AND METHODS OF MANUFACTURE AND OPERATION

[75] Inventors: Vladimir V. Ivanov; Uriy I. Danilov; Michael V. Zakharov, all of Saratov, Russian Federation

[73] Assignee: MRA Technology Group, Calif.

[21] Appl. No.: 233,816

[22] Filed: Apr. 26, 1994

[51] Int. Cl.[6] ..... H01J 17/12; H05B 39/00

[52] U.S. Cl. ..... 313/573; 313/594; 313/607; 313/634; 313/234; 313/631; 313/635; 313/636; 313/101; 313/105

[58] Field of Search ..... 313/572, 573, 313/574, 577, 594, 598, 601, 607, 620, 491, 493, 634, 234, 631, 635, 636; 315/101, 105

[56] References Cited

U.S. PATENT DOCUMENTS

| | | | |
|---|---|---|---|
| 2,040,753 | 5/1936 | McIlvaine | 315/46 |
| 3,339,135 | 8/1967 | Anderson | 324/122 X |
| 3,345,280 | 10/1967 | Berghaus | 313/567 |
| 3,651,366 | 3/1972 | Giannini | 313/573 |
| 3,947,722 | 3/1976 | Storm et al. | 313/607 X |
| 4,117,374 | 9/1978 | Witting | 313/491 X |
| 4,329,622 | 5/1982 | Corona et al. | 313/488 X |
| 4,340,843 | 7/1982 | Anderson | 315/205 |
| 4,728,857 | 3/1988 | English et al. | 313/642 |
| 4,748,381 | 5/1988 | Ganser et al. | 315/200 R |
| 4,754,194 | 6/1988 | Feliciano et al. | 313/491 |
| 4,772,822 | 9/1988 | Van den Nieuwenhuizen | 313/631 X |
| 4,879,493 | 11/1989 | Mstuno et al. | 313/491 X |
| 4,899,092 | 2/1990 | Tsuji et al. | 313/607 X |
| 5,025,197 | 6/1991 | Ganser et al. | 313/172 |
| 5,051,655 | 9/1991 | Wiley | 313/631 |
| 5,084,655 | 1/1992 | Van Zanten | 315/290 |
| 5,087,859 | 2/1992 | Blankers | 315/209 R |
| 5,101,330 | 3/1992 | Suzuki | 313/607 X |
| 5,130,609 | 7/1992 | Durand | 315/219 |
| 5,140,221 | 8/1992 | Ichinase | 313/607 X |
| 5,391,960 | 2/1995 | Moribayashi et al. | 313/607 X |

FOREIGN PATENT DOCUMENTS 59-33746 2/1984 Japan .

OTHER PUBLICATIONS

Sokolova N. S., Lushkin V. V., Ivanov V. V., "*A Luminescence Gas discharge Indicator Device with Reduced Breakdown Voltage*", Electronaya Technica, Series 4, Electrovacuum and Gas Discharge Devices, Issue 2, 1972, pp. 118–119.

*Primary Examiner*—Sandra L. O'Shea
*Assistant Examiner*—Ashok Patel
*Attorney, Agent, or Firm*—Frazzini & Kassatly; Samuel Kassatly

[57] ABSTRACT

A low breakdown voltage gas discharge device includes an envelope filled with an appropriately selected working substance. Two main electrodes are sealed in a vacuum-tight manner inside the envelope, and are separated by a predetermined distance. A supplemental electrode extends between the main electrodes along the direction of the electrical discharge, and has its geometrical and electrical parameters satisfy the following equation:

$$S=I_d/C,$$

where S is the surface area of the supplemental electrode and depends on the distance between the main electrodes, $I_d$ is the current flowing in the supplemental electrode during normal glow discharge, and C is a constant characterizing the current $I_d$, the composition of the supplemental electrode, and the type and pressure of the working substance. The supplemental electrode is connected to an AC or DC power source via a switch, so that the supplemental electrode always acts as a preparatory glow discharge cathode.

30 Claims, 20 Drawing Sheets

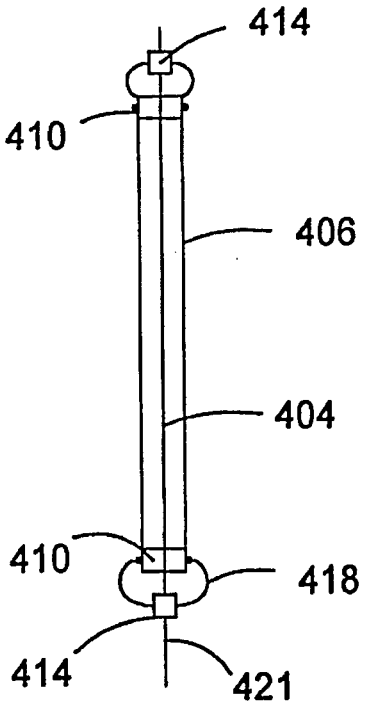
FIGTURE 14
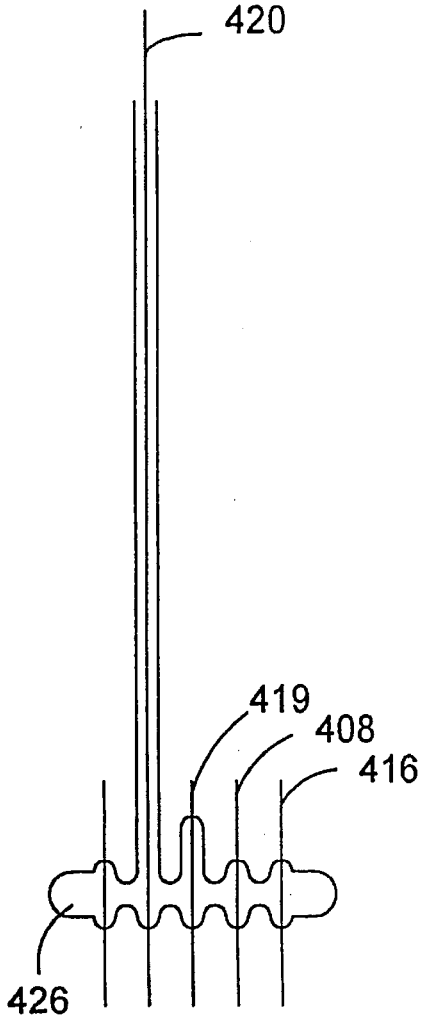
FIGURE 15A
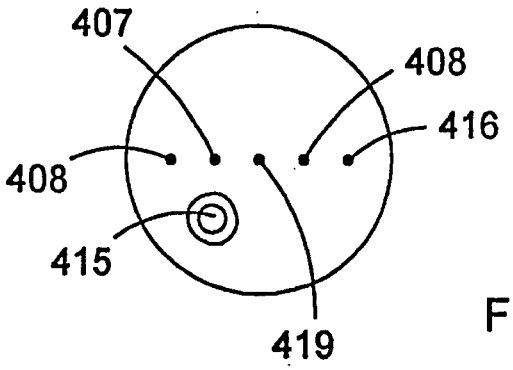
FIGURE 15B

LOW BREAKDOWN VOLTAGE GAS DISCHARGE DEVICE AND METHODS OF MANUFACTURE AND OPERATION

BACKGROUND OF THE INVENTION

1. Field of the Invention

The present invention relates in general to the field of gas discharge devices, and more particularly discharge devices for use in various applications, including without limitation, voltage stabilizers, gasotrons, noise generators, gas-discharge light devices, neon lamps, low pressure fluorescent mercury lamps, high pressure fluorescent mercury lamps, bactericidal lamps, eritem lamps, high pressure mercury lamps, high pressure mercury-quartz lamps, super high pressure mercury-quartz lamps, super high pressure gas lamps, low and high pressure sodium lamps, metal-halide lamps, spectral lamps, and a multitude of other applications 2. Description of the Related Art

I. Gas Discharge Devices

In general, gas discharge devices have numerous applications. For instance, they can be used in electronics and radio engineering as voltage stabilizers and thyratrons; in high power industrial systems as gasotrons and mercury filled rectifiers; for domestic, office and industrial lighting; in medicine as bactericidal and eritem lamps; in computing devices such as decade-counting tubes, nuclear particle counters, noise generators, etc.

A typically gas discharge device includes a bulb which is filled with a working substance, and which contains main and supplemental electrodes. The number and design of these electrodes depend on the particular application for the gas discharge device. Some of the common shortcomings of the conventional gas discharge devices include the significant variation and instability of the breakdown voltage, and the relatively large power consumption caused by the large voltage difference between the breakdown voltage and the operation voltage, causing intensive sputtering of the cathode material, gas hardening (i.e., gas absorption by the sputtered metal film), and shortening of the useful life span.

There is therefore an unsatisfied need for new gas discharge devices with a relatively low and stable breakdown voltage, which provides the ability to control the anode current, and which have a prolonged useful life and relatively high power efficiency.

II. Voltage Stabilizers

A voltage stabilizer is an uncontrolled gas discharge device with glow or corona discharge forming in the mixture of gases (working substance). It is used to support a constant output voltage on a load, when the load current or power supply voltage changes. The voltage stabilizer can have a glass or ceramic bulb, which is filled with a mixture of inert gases, and contains two metal electrodes, an anode and a cathode. These electrodes have individual leads, and are activated in order to reduce the breakdown voltage, and to maintain a certain voltage between the electrodes.

Some of the common shortcomings of the conventional voltage stabilizers are the relatively low stabilizing voltage (less or equal to 160 V); and the relatively large power consumption resulting from the large voltage difference between the breakdown voltage and the operation voltage.

Therefore, there is still an unsatisfied need for a new voltage stabilizer with higher stabilizing voltages, i.e., voltages from few hundred volts to several kilovolts, and power efficiency.

III. Gasotrons

A gasotron is a gas discharge device with a non self-sustaining arc discharge or an self-sustaining glow discharge formed in the mixture of gases or mercury vapors. A gasotron is used to rectify the alternating current of industrial frequency. It includes a glass bulb filled with inert gas or mercury vapors. Two electrodes, an anode and a filamentary cathode are placed inside the bulb, and have individuals leads.

Some of the common shortcomings of the conventional gasotrons are the instability of the breakdown voltage, the relatively large power consumption resulting from the large voltage difference between the breakdown voltage and the operation voltage, causing sputtering of the cathode material, gas hardening and reduction of the useful life.

There is therefore a substantial need for a gasotron with a stable breakdown voltage, which provides the ability to control the anode current, and which has a prolonged useful life and relatively high power efficiency.

IV. Noise Generators

A noise generator is a gas discharge device that generates random aperiodic (nonperiodic) oscillations. It is used to simulate real noise when the behavior of electronic devices is investigated and measurements are made. The gas discharge noise generator includes a glass bulb which is filled with gas, such as argon or neon, whose pressure can range from one millimeter to tens of millimeters of mercury column. The bulb is hermetically sealed and contains an anode and a filamentary cathode.

Among the common shortcomings of gas discharge noise generators are the sensitivity to anode current variations resulting from the large variation, i.e., instability of the breakdown voltage, the large difference between the breakdown voltage and the operation voltage, and the need for special ballast devices.

There is therefore an unsatisfied need for a new noise generator with a relatively low and stable breakdown voltage, which does not require special ballast devices, and which has a relatively high power efficiency.

V. Gas Discharge Light Devices

A gas discharge light device includes a gas discharge lamp and an electrical ballast circuit. The gas discharge lamp emits light energy with the required spectral characteristics and uses the fluorescence of the glow or arc discharge. Generally, the gas discharge light devices are divided into four groups: glow discharge devices, devices with direct emission, luminescence devices, and spark discharge pulse devices.

The present level of technical development is determined by the following types of existing gas discharge light devices:

glow discharge;

luminescence (fluorescence) mercury low pressure (0.01–1 mm Hg);

luminescence (fluorescence) mercury high pressure (0.3–3 atm);

mercury and mercury-quartz high pressure;

mercury-quartz super high pressure (from 3 to several hundreds atmospheres);

gas super high pressure (inert gas under pressure of 10–15 atm);

spectral arc discharge (filled with argon and metal vapors: mercury, cadmium, zinc, thallium, sodium or cesium);

filled with hydrogen; and pulse gas discharge.

The gas discharge light devices can be used as indicators of electrical signals or voltages; for domestic, office, industrial and street lighting; in light sensitive copiers; in motion-picture projectors; for high speed motion-picture shooting; in photography, optical locators/range finders, projectors, spectroscopy, refractoscopy, chemistry, medicine, optical telephony, high intensity light beams in optical devices, ultraviolet continuous spectrum light sources, measurement devices, automation and telemetry, laser excitation sources, numerical and color visual indicators including displays, industrial and advertising systems and panels, and for other purposes.

A typical gas discharge light device includes a gas discharge lamp and an electrical ignition circuit which can be located inside or outside the lamp. A ballast circuit provides the required electrical parameters for the lamp electrodes. The gas discharge lamp includes a bulb made of optically transparent material and filled with a working substance such as an inert gas, metal vapors, or a mixture of gases and vapors. Two electrodes, an anode and a cathode are placed inside the bulb, and have individual leads.

The working substance is used to generate light energy. Lighting occurs as a result of the current flowing through the working substance. In order to provide an effective emission of light energy, the optimum pressure and discharge characteristics of the working substance should be determined. In order to provide the required spectrum, the composition of the working substance and the luminescence (fluorescence) coating need to be determined.

The ballast electrical circuits of the gas discharge lamp consist of reactive elements such as chokes, resonant chokes, choke-transformers, transformers and capacitors.

There has been some attempts to reduce the breakdown voltage in gas discharge light devices. For example, a luminescence low pressure mercury lamp is described in U.S. Pat. No. 2,040,753 to McIlvaine. The lamp includes a bulb which is filled with gas. The anode, cathode and supplemental electrode are placed and hermetically sealed inside the bulb. A supplemental electrode is made of a thin wire (filament) with high resistance. When the lamp is turned on, the filament is heated up and becomes a source of thermoelectrons. This lamp did not meet with high market demand because of the high power consumption of the filament, and the high temperatures of the bulb surface.

Another luminescence gas discharge indicator device was described by Sokolova N. S., Lushkin V. V., Ivanov V. V. in the article entitled "A Luminescence Gas discharge Indicator Device with Reduced Breakdown Voltage", Electronaya Technica, Series 4, Electrovacuum and Gas Discharge Devices, Issue 2, 1972, pp. 118–119. This device operates only with a DC or pulsating power supply. As illustrated in FIG. 1, the gas discharge device 10 includes a bulb 11 which is filled with gas and mercury vapor. The bulb 11 is U-shaped, it is made of glass and is hermetically sealed. The bulb surface is partially covered (working area) with phosphor.

A cathode 12 terminating in a lead 20, an anode 13 terminating in a lead 19, and a supplemental electrode 14 terminating in a lead 16 are disposed within the bulb 11. The supplemental electrode 14 is made of a thin metallic filament, and extends between the anode 13 and the cathode 12. The cathode 12 is hollow along its axial length, and is cylindrically shaped. The anode 13 is disk shaped. The length of the working area is between 30–100 mm. The supplemental electrode 14 reduces the lamp breakdown voltage.

In operation, a DC voltage is applied between the cathode 12 and the anode 13 to initiate a preparatory discharge between the supplemental electrode 14 and the anode 13. The supplemental electrode 14 acts as a preparatory discharge cathode. When the appropriate conditions, as described below, are reached, the preparatory discharge spreads through the entire surface of the supplemental electrode 14 and the main discharge is then initiated between the cathode 12 and anode 13.

In this gas discharge device no constraints are placed on the filament thickness, distance between the anode 13 and the cathode 12, the pressure and type of gas, or the filament material. As a result, the parameters of this device such as filament diameters or distances between electrodes vary significantly, in some cases its power consumption is high, and has a relatively short useful life.

Furthermore, the gas discharge indicator cannot be readily reproduced, and has a relatively low efficiency, high breakdown voltage, and a short life span, due to the undetermined relationship between the dimensions of the supplemental electrode 14, the type and pressure of the working substance, and the distance between the anode 13 and the cathode 12.

If for example, the supplemental electrode 14 has a relatively large diameter, the breakdown voltage should be increased, in order to cause the preparatory discharge to spread throughout the entire length of the supplemental electrode 14. On the other hand, if the supplemental electrode 14 has a relatively small diameter, the current flowing therethrough will be very high, thereby causing material sputtering of the supplemental electrode 14, hence reducing the useful life span of the gas discharge indicator.

Furthermore, when the gas discharge indicator is supplied with an alternating input (AC) voltage, for instance, a positive half-cycle is applied between the electrodes 12 and 13, such that the electrode 12 is at a higher potential than the electrode 13, the supplemental electrode 14 is also at a higher potential than the electrode 13. Therefore, the supplemental electrode 14 acts as an anode, while the electrode 13 acts as a cathode, thus causing main discharge to be formed in the region 17, between the supplemental electrode 14 and the cathode electrode 13. Consequently, no discharge is generated in the chamber region between the electrodes 12 and 13, and the indicator consumes power but does not radiate light.

Some of the common and most significant shortcomings of conventional gas discharge light devices are as follows:

in long lamps with a large distance between the anode and the cathode, the discharge is initiated by means of high voltage pulses generated by ballast devices;

the breakdown voltage depends on a number of destabilizing factors, such as the process of charge accumulation on the bulb walls, and the capacitance relative to ground potential, etc., and has statistical nature;

the use of arc discharge in low power lamps (1–10 W) causes excessive power consumption;

the lamps behave as noise sources and cause radio interference;

the lack of control of the light energy emission;

the ballast elements consisting of a coil with a magnetic core have large power losses and generate noise and radio interference;

the nonlinear waveform distortions of the input supply voltage generate noise and cause radio interference;

the standard ballasts with reactances do not allow the control of the lamp light energy emission;

increase or decrease of the supply voltage reduces the useful life of the lamp;

the electronic ballasts create high peak voltages, which causes a reduced lamp life span, a relatively large number of failures, and a high level of electromagnetic emission; and the hybrid ballasts can become hazardous radiation sources as a result of high peak values of voltage harmonics.

It is therefore apparent that there is an unfulfilled need for a new gas discharge light device with the following characteristics:

low breakdown voltage;

optimal ignition conditions such as the distance between the electrodes, the electrode material, the type and pressure of the working substance;

ability to control the light energy emission;

usable for different types of discharge, such as normal and abnormal glow, discharge with a hollow cathode, and arc and spark discharge;

usable with different types of cathodes such as cold, hollow or filamentary;

usable with different cathode shapes and configurations, dimensions and composition;

usable with different types of working substances, such as gases, vapors, and mixtures of gases and vapors;

usable with different pressures of working substances, i.e., low, high and super high;

the bulb could assume different designs, i.e., shape, configuration, dimensions, materials, coating and treatment;

operable with different types of power supply voltages, i.e.,. DC, AC, pulsating, pulses, high frequency, etc.;

operable with different types of ballasts, such as reactive, electronic, hybrid, etc., or active current limiting elements;

capable of coding light signals;

useful life span independent of the number of ignitions;

has a very low power consumption; and is very efficient.

VI. Neon Lamps

A neon lamp is a gas discharge device with a glow discharge emission. Conventionally, neon lamps are used as light indicators of electrical signals and voltages; and in numerical and color visual indicators in industrial and advertising information systems, signs and panels.

Typically, a neon lamp can have a glass bulb of different shapes and dimensions, with two electrodes, an anode and a cathode being placed inside the bulb. These electrodes are coated with a film of barium, calcium or cesium for reducing or maintaining the operation voltage. Neon lamps operating on AC voltage have identical electrodes. Neon lamps with a small distance between their electrodes, in the range of several millimeters, have a low efficiency due to the large difference between the breakdown voltage and the operation voltage. In order to operate long neon lamps with a big distance between its electrodes, start-control devices (i.e., choke-transformers) are used.

There is therefore a need for neon lamps with a low breakdown voltage and a high efficiency.

VII. Low Pressure Fluorescent Mercury Lamps

Low pressure fluorescent mercury lamps are devices with an electrical discharge formed in the mixture of inert gases and mercury vapors. These lamps use phosphor light emission. The low pressure fluorescent mercury lamps work on the principle of double energy conversion. The discharge energy affects the special, internal to the bulb, fluorescence coating (phosphors). It causes energy emission in the visible area of spectrum. The energy of electrical discharge in the mercury vapor is converted into ultraviolet radiation energy with a specific wavelength (short wavelength). Phosphors, irradiated by ultraviolet rays, generate the energy at a different wavelength (long wavelength). This explains why phosphors generate visible light in the range from ultraviolet to red (relatively long wavelength radiation).

Low pressure fluorescent mercury lamps are used as indicators of electrical signals and voltages, as well as for domestic and industrial lighting. The low pressure fluorescent mercury lamps can be made from glass conduits of different lengths, shapes and diameters. They have two special double pin bases that allow them to be plugged in special receptacles for connection to the electrical power.

The electrodes are welded to the end faces of the conduit and a thin layer of phosphor coating is made on the internal surface of the conduit. The electrodes are made of tungsten and have a helical shape with oxide coating. The electrodes have two leads which terminate in pins fixed to the base. The conduits are filled with inert gas, such as argon, and a dosed amount of mercury.

To start the discharge (breakdown) in the lamp it is necessary to heat up the electrodes in order to create a temporary voltage rise on them. Accordingly there are several possible ways to ignite low pressure fluorescent mercury lamps; they are as follows:

pulse ignition (the electrodes are heated up and a short voltage pulse is generated);

fast ignition (the electrodes are heated up significantly and voltage is increased);

instantaneous ignition (there is a fast voltage rise without heating of the electrodes).

The ignition circuit includes external (relative to the bulb) ballast devices, which are used to provide the required voltages and currents in the start and nominal modes of the low pressure fluorescent mercury lamps powered up with AC voltages, such as 110, 127, 220 or 380 Volts. These low pressure fluorescent mercury lamps require high breakdown voltage and consequently the use of ballast devices. The circuits for low pressure fluorescence mercury lamps include such reactive elements as chokes, resonant chokes, choke-transformers, transformers and capacitors.

All inductive elements that include a coil with a magnetic core have big power losses associated with the heating of the core. These elements behave as sources of noise and generate radio interference caused by the nonlinear distortions of the supply voltage, especially during ignition and extinction transients. In addition, the standard ballasts with reactances do not permit the control of the lamp light emission energy. The common variations in the supply voltage reduce the useful life of the lamp. Currently used electronic ballasts which convert the low frequency voltage into DC voltage and subsequently to high frequency voltage, have significant shortcomings, some of which are as follows: large peak voltages which shorten the life span of the lamp; significant number of failures; and high level of electromagnetic radiation. The hybrid ballasts which include reactive and electronic elements have similar shortcomings. Furthermore, these ballasts can behave as hazardous sources of radiation as a result of the high peak values of the voltage harmonics.

The useful life span of the lamp depends on the following factors: voltage fluctuations in the supply line; ambient temperature; number of ignitions or start up (the less the number of ignitions is, the less the deterioration of electrodes oxide layer coating); the deterioration process of the oxide coating is accentuated by the low supply voltage and low ambient temperature.

Consequently, there is still a significant need, which is still unsatisfied, for new low pressure fluorescent mercury lamps with the following characteristics:

low breakdown voltage (as a rule directly from the power line);

optimal by ignition conditions mechanical characteristics of the lamp working area, such as the distance between electrodes, the type and pressure of the working substance, and the shape and diameter of the bulb;

the capability to control the energy of light emission;

ability to be used with different types of power supply voltages such as DC, AC, pulsating, pulse, high frequency, etc.;

ability to be used with different types of ballasts, such as reactive, electronic, hybrid, etc., or active current limiting elements;

capability to code light signal;

the useful life span is independent of the number of ignitions;

very low power consumption;

stable breakdown voltage;

high efficiency; and low level of noise and radio interference.

VIII. High Pressure Fluorescence Mercury Lamps

A high pressure fluorescent mercury lamp forms an electrical arc discharge in the high pressure mercury vapors using the effect of phosphor lighting. High pressure fluorescent mercury lamps are used for industrial, street and highway lighting, and generally have an oval shaped bulb made of thermoresistive glass. A high pressure mercury-quartz conduit lamp is mounted inside the bulb, which has its internal surface coated with thermoresistive phosphor. The bulb is filled with carbon dioxide. During the gas discharge in mercury vapors, within the quartz conduit lamp, ultraviolet radiation is generated. This radiation affects the phosphor coating which emits light in the visible spectrum of the red color bandwidth. Such an emission (red color) is mixed with ultraviolet emission of the quartz conduit, for creating a light whose spectrum is close to the white light.

Some of the common shortcomings of the high pressure fluorescent mercury lamps are as follows: there is a need to use special ignition devices, such as a choke-triggered spark gap, rectifier, capacitor or resistor; there is a large difference between the breakdown voltage and the maintaining voltage.

Therefore, there is an unsatisfied need for new high pressure fluorescent mercury lamps having a low breakdown voltage, which do not use special ballast devices; and which have a relatively higher efficiency.

IX. Bactericidal Lamps

A typical bactericidal lamp is a low pressure gas discharge mercury lamp which forms an electrical arc discharge in the mercury vapors, and which operates in the short wavelength spectrum of the ultraviolet spectrum. Bactericidal lamps are commonly used for disinfecting the air in a room, water, food, etc.

A bactericidal lamp generally has a cylinder bulb made of quartz or other ultraviolet transparent glass that allows ultraviolet rays to pass therethrough. This lamp has two special double pin bases that allow it to be plugged in corresponding receptacles for connection to the electrical power. The electrodes are connected to the ends of the bulb; they are made of tungsten with an oxide coating, and are helically shaped. The electrodes have two leads terminating in pins fixed to the base, and the bulb is filled with an inert gas, such as argon and a dosed amount of mercury.

In order to start the discharge (breakdown) in the lamp, it would be necessary to heat up the electrodes at the time when it is connected to the line voltage, and also to provide an increased voltage on the electrodes. This is done by using ballast devices. Furthermore, the bactericidal lamps require an increased breakdown voltage, and consequently will require the use of special ballasts. The lamp external circuitry includes such reactive elements as chokes, resonant chokes, chokes-transformers, transformers and capacitors. All the inductive elements with a coil and a magnetic core have present large power losses related to the heating of the core, and act as sources of noise and generate radio interference caused by nonlinear distortions of the power supply voltage, especially during transients that take place during the lamp ignition and extinction. Furthermore, the conventional ballast devices cannot regulate light output energy.

As a result, there is a need for new bactericidal lamps with the following characteristics:

low breakdown voltage (usually directly from the AC power supply);

optimal by ignition conditions mechanical characteristics of fie working part of the lamp, such as the distance between the electrodes, the composition of the electrodes, the types and pressures of the working substance, and the shapes and diameters of the bulb;

capability to control the light emission energy;

high efficiency; and low level noise and radio interference.

X. Eritem Lamps

A conventional eritem lamp is a low pressure gas discharge fluorescent mercury lamp forming an electrical arc discharge in the mercury vapors. This lamp operates in the middle wavelength range of the ultraviolet spectrum and is used to compensate for shortage of ultraviolet radiation. Eritem lamps are commonly used in medical applications.

A typical eritem lamp has a cylindrical bulb made of special UV transparent glass with its internal surface coated with special phosphor that emits light energy in the long wavelength spectrum range near the maximum eritem effectiveness. The phosphor converts the mercury discharge radiation into radiation in the middle wavelength range of the ultraviolet spectrum. This lamp has two special double pin bases that allow it to be plug them in corresponding receptacles for connection to the power line. The electrodes are connected to the ends of the bulb; they are made of tungsten with oxide coating, and have a helically shaped. The electrodes have two leads terminating in pins fixed to the base. The bulb is filled with an inert gas, such as argon and a dosed amount of mercury.

To start discharge in the lamp (breakdown) it would be necessary to heat up its electrodes at the time when it is connected to the power line, and also to provide increased voltage across the electrodes. This is done by using ballast devices. The eritem lamps require an increased breakdown voltage, and consequently the use of special ballasts.

The lamp circuitry includes such reactive elements as chokes, resonant chokes, chokes-transformers, transformers and capacitors. All the inductive elements having a coil with a magnetic core present extensive an power loss related to the heating of the core, and acts as sources of noise and generate radio interference caused by nonlinear distortions of the power supply voltage, especially during transients which occur at the time of the lamp ignition and extinction. Additionally, the standard ballasts with reactances do not permit the control of the energy of light emission.

As a result, there is a need to develop eritem lamps with the following characteristics:

low breakdown voltage (usually directly from an AC power line);

optimal by ignition conditions mechanical characteristics of the working part of the lamp, such as the distance between the electrodes, the electrodes composition, the types and pressures of the working substance, and the shapes and diameters of the bulb;

the capability to control the light emission energy;

high efficiency; and low level noise and radio interference levels.

XI. High Pressure Mercury Lamps

A high pressure mercury lamp is a high pressure gas discharge lamp which forms an electrical arc discharge in the mixture of argon and mercury vapors. The lamp emits energy in the visible and ultraviolet range of the spectrum. High pressure mercury lamps are used mainly for light sensitive duplication.

A typical high pressure mercury lamp includes a bulb made of a thermoresistive glass with a gas discharge conduit filled with argon and mercury and positioned inside the bulb. The bulb is brought to a high vacuum, and tungsten electrodes are connected to both ends of the gas discharge conduit. To facilitate the ignition process, additional electrodes are placed close to the main electrodes, and each additional electrode is connected to the opposite main electrode through a large value resistance. During the lamp ignition, the glow discharge, which provides gas ionization, starts between the supplemental and the main electrodes.

Some of the most common shortcomings of the high pressure mercury lamps are the requirement to use special ballasts; and the large difference between the breakdown voltage and the maintaining voltage.

XII. High Pressure Mercury-quartz Lamps

A high pressure mercury-quartz lamp is a high pressure gas discharge lamp which forms an electric arc discharge in the mixture of argon and mercury vapors. It is used mainly for light sensitive duplication, photo chemistry, spectroscopy and other purposes.

A typical high pressure mercury-quartz lamp includes a tube or bulb made of quartz glass and filled with argon and mercury. It further includes tungsten electrodes connected to its ends.

Some of the common shortcomings of such high pressure mercury-quartz lamps are the requirement for special ballasts; a long duration of transient process after the voltage is applied; and the large difference between the breakdown voltage and the maintaining voltage.

Therefore, there is a need for a new high pressure mercury quartz lamp with a low breakdown voltage, which does not require special ballasts, which has a stable ignition conditions, and a higher efficiency.

XIII. Super High Pressure Mercury-quartz Lamps

A super high pressure mercury lamp is a gas discharge lamp which forms an electric arc discharge in mercury vapors. The lamp emits energy in the visible and ultraviolet range of the spectrum. The super high pressure mercury lamps are generally used to create high intensity narrow light beams, and are mainly used in optical devices.

A typical super high pressure mercury lamp includes a spherical bulb made of quartz glass. The bulb is filled with a dosed amount of mercury. The main electrodes are retained in the bulb. In order to facilitate the ignition process, the supplemental electrode is placed between the main electrodes inside the bulb. During the lamp ignition, the supplemental electrode is connected for a short period of time to the output terminal of a high frequency inductor.

Some of the most common shortcomings of the super high pressure mercury lamps include the requirement to use special ballasts; a long duration of transient process after the voltage is applied; and the large difference between the breakdown voltage and the maintaining voltage.

Therefore, there is a need for super high pressure mercury lamps with a low breakdown voltage and stable ignition mode, which do not require special ballasts, and which are highly efficient.

XIV. Super High Pressure Gas Lamp

A super high pressure gas lamp is a gas discharge lamp which forms an electric arc discharge in a xenon gas, and which emits energy with continuous spectrum from, and including the ultraviolet range to the infrared range. Super high pressure gas lamps are used as lighting devices in motion-picture projectors, an for lighting wide areas and large rooms.

A typical super high pressure gas lamp includes a spherical or cylindrical bulb made of quartz glass. The bulb is filled with an inert xenon gas, and the main electrodes are retained inside the bulb. In order to start the arc discharge, complex ballasts are required.

Some of the common shortcomings of the super high pressure gas lamps include the requirement for special ignition ballasts; and the breakdown voltage is significantly higher than the line voltage.

Consequently, there is a need for super high pressure gas lamps with a low breakdown voltage; a stable ignition mode; and a high efficiency.

XV. Low Pressure Sodium Lamps

The low pressure sodium lamp is a gas discharge lamp which forms an electric arc discharge in a mixture of sodium vapors and inert gas at low pressure. It is used for lighting of industrial facilities, streets and highways.

A typical low pressure sodium lamp includes a bulb made of special glass and resistive to sodium vapors. The bulb is filled with a dosed amount of pure metallic sodium. In order to cause the ignition of the small amount of the inert gas, neon, helium or argon is pumped inside the bulb.

Some of the common shortcomings of the low pressure sodium lamps include the requirement to use special ballasts for ignition; a large difference between the breakdown and the maintaining voltage; a long duration for the electrical and light characteristics to stabilize during the lamp ignition.

Therefore, there is a need to develop new low pressure sodium lamps having a low breakdown voltage; which do not require special ballasts; with a short stabilization time for the electrical and light characteristics, with stable ignition conditions, and higher efficiency.

XVI. Spectral Lamps

A spectral lamp is a gas discharge lamp which forms an arc discharge in a mixture of argon and metal vapors, and has a linear emission spectrum. Spectral lamps are generally used in spectroscopy, refractoscopy, and lighting engineering, A typical spectral lamp includes a bulb made of regular or UV transparent glass, with a gas discharge bulb filled with argon and metal vapors such as mercury, zinc, cadmium, thallium, sodium or cesium, and secured inside the bulb. The bulb can be made of quartz or special glass. The lamp is connected to the voltage line in series with a ballast (choke). The ignition mode settles in 7–10 minutes after the initiation of the ignition.

Some of the common shortcomings of such devices include the requirement to use special ballasts for the ignition, and the large difference between the breakdown voltage and the maintaining voltage.

Therefore, there is a need to develop new spectral lamps with a low breakdown voltage; which do not require special ballasts; which have a short stabilization time (a stabilization time is the period of time before the operational electrical and parameters stabilize); and which are highly efficient.

The following patents further illustrate the state of the art in the relevant field:

McIlvaine, U.S. Pat. No. 2,040,753 (1936), describes an electric ray producing device, or a lamp, which combines the principle of filament operation and that of positive-column discharge illumination. The lamp includes a container or bulb 1, and leading-in wires 6 and 7, between which is connected a filament 8. As illustrated in FIG. 1 of that patent, two electrodes 10—10 are carried by the leading-in wires and face each other. When a current is applied to the lamp, the glowing filament 8 ionizes the gas to the point where an independent discharge begins to take place between the electrodes 10—10, thus resulting in an increase in the amount of light produced. The filament acts as a filament in an incandescent bulb.

Corona et al, U.S. Pat. No. 4,329,622 (1982) is assigned to Xerox Corporation and deals with photocopying problems, such as the end falloff illumination of the fluorescent tube. Low emissive electrodes 32 and 34 are used as substitute for a ballast. However, the disclosed fluorescent tube does not include an inter-electrode supplemental cathode or filament.

Anderson, U.S. Pat. No. 3,339,135 (1967), entitled "Method For Measuring The Intensity Of A Magnetic Field Utilizing A Gas Discharge Device".

Burghs, U.S. Pat. No. 3,345,280 (1967), entitled "Method And Apparatus For Controlling Glow Discharge Processes".

Witting, U.S. Pat. No. 4,117,374 (1978), entitled "Fluorescent Lamp With Opposing Inverse Cone Electrodes".

Anderson, U.S. Pat. No. 4,340,843 (1982), entitled "Keep-Alive Circuit For Gas Discharge Lamp".

English et al., U.S. Pat. No. 4,728,857 (1988), entitled "Vertical Running, High Brightness, Low Wattage Metal Halide Arc Lamp".

Ganser et al., U.S. Pat. No. 4,748,381 (1988), entitled "Circuit Arrangement For A.C. Operation of Gas Discharge Lamps".

Folacin et al., U.S. Pat. No. 4,754,194 (1988), entitled "Fluorescent Light Bulb".

Van den Nieuwenhuizen et al., U.S. Pat. No. 4,772,822 (1988), entitled "High-Pressure Discharge Lamp Having Electrodes Wound In Opposite Sense".

Matsumo et al., U.S. Pat. No. 4,879,493 (1989), entitled "Low-Pressure Discharge Lamp".

Ganser et al., U.S. Pat. No. 5,025,197 (1991), entitled "Circuit Arrangement For A.C. Operation Of High-Pressure Gas Discharge Lamps".

Wiley, U.S. Pat. No. 5,051,655 (1991), entitled "Electrodes For Single Ended Arc Discharge Tubes".

Van Zenten, U.S. Pat. No. 5,084,655 (1992), entitled "Circuit Arrangement Suitable For Igniting A High-Pressure Discharge Lamp".

Blankers, U.S. Pat. No. 5,087,859 (1992), entitled "Switching Arrangement For High Pressure Discharge Lamp".

Durand, U.S. Pat. No. 5,130,609 (1992), entitled "Illuminating Device Incorporating Gas-Filled Chambers".

Suzuki, Japanese patent No. 59-33746 (1984), entitled "High Pressure Electric-Discharge Lamp Device" and assigned to Mitsubishi Denki K.K.

SUMMARY OF THE INVENTION

Therefore, it is an object of the present invention to provide a new gas discharge device with a relatively low and stable breakdown voltage, which provides the ability to control the anode current, and which has a prolonged useful life and relatively high power efficiency, such that these parameters should remain substantially the same for gas discharge devices with different applications, different types of discharge, such as corona, glow, arc, spark or hollow cathode; different types of cathodes such as cold, hollow, or incandescent; different designs of the cathodes such as the shape, configuration, size, and composition of the cathodes; various working substance such as gases, vapors, mixtures of vapors and gases; various pressures of the working substances; different bulb designs such as the shape, configuration, dimensions, materials, coating and treatment of the bulb; different types of power supply voltages such as DC, AC, pulsating, pulse, high frequency; and different types of ballasts and current limiting resistors.

It is another purpose of the present invention to provide a new voltage stabilizer with higher stabilizing voltages, ranging from few hundred volts to several kilovolts, and a higher power efficiency.

It is still another object of the present invention to provide a new gasotron with a stable breakdown voltage, which provides the ability to control the anode current, and which has a prolonged useful life and relatively high power efficiency.

It is a further object of the present invention to provide a new noise generator with a relatively low and stable breakdown voltage, which does not require special ballast devices, and which has a relatively high power efficiency.

It is yet another object of the present invention to provide a new gas discharge light device having a low breakdown voltage; optimal by ignition conditions mechanical characteristics such as the distance between the electrodes, the electrode material, the type and pressure of the working substance, and the shape and diameter of the bulb; and the ability to control the light energy emission; and further including one or more of the following characteristics:

usable for different types of discharge, such as normal and abnormal glow discharge with a hollow cathode, and arc and spark discharge;

usable with different types of cathodes such as cold, hollow or incandescent;
usable with different cathode shapes and configurations, dimensions and composition;
usable with different types of working substances, such as gases, vapors, and mixtures of gases and vapors;
usable with different pressures of working substances, i.e.., low, high and super high;
the bulb could assume different designs, i.e., shape, configuration, dimensions, materials, coating and treatment;
operable with different types of power supply voltages, i.e., . . . DC, AC, pulsating, pulses, high frequency, etc.;
operable with different types of ballasts, such as reactive, electronic, hybrid, etc., or active current limiting elements;
capable of coding light signals;
the useful life span is independent of the number of ignitions;
has a very low power consumption; and
is very efficient.

It is also a further object of the present invention to provide a new neon lamp with a low breakdown voltage and high efficiency.

It is yet another object of the present invention to provide a new low pressure fluorescent mercury lamp with one or more of the following characteristics:
a generally low breakdown voltage;
a low breakdown voltage as a result of the use of supplemental electrodes with gaps;
with a relatively long distance between the main electrodes;
optimal by ignition conditions mechanical characteristics of the lamp working area, such as the distance between electrodes, the type and pressure of the working substance, and the shape and diameter of the bulb;
the capability to control the energy of light emission;
usable with different types of discharges such as normal and abnormal glow, arc, mixed or hollow cathode discharge;
usable with different bulb designs such as the shape, configuration, dimensions, coatings and treatment;
ability to be used with different types of power supply voltages such as DC, AC, pulsating, pulse, high frequency, etc.;
ability to be used with different types of cathodes such as cold, hollow of filamentary, as well as different shapes, dimensions, composition and material;
ability to be used with different types of ballasts, such as reactive, electronic, hybrid, etc., or active current limiting elements;
ability to code light signal;
the useful life span is independent of the number of ignitions;
very low power consumption;
stable breakdown voltage;
high efficiency; and
low level of noise and radio interference.

It is another object of the present invention to provide a new high pressure fluorescent mercury lamp having a low breakdown voltage; which does not require special ballast devices; and which has a relatively higher efficiency.

It is still another object of the present invention to provide a new bactericidal lamp with one or more of the following characteristics:
low breakdown voltage (usually directly from the AC power supply);
optimal by ignition conditions mechanical characteristics of the working part of the lamp, such as the distance between the electrodes, the composition of the electrodes, the types and pressures of the working substance, and the shapes and diameters of the bulb;
capability to control the light emission energy;
high efficiency; and
low level noise and radio interference.

An additional object of the present invention is to provide a new eritem lamp having one or more of the following characteristics:
low breakdown voltage (usually directly from an AC power line);
optimal by ignition conditions mechanical characteristics of the working part of the lamp, such as the distance between the electrodes, the electrodes composition, the types and pressures of the working substance, and the shapes and diameters of the bulb;
the capability to control the light emission energy;
high efficiency; and
low level noise and radio interference levels.

Another object is to provide a new high pressure mercury lamp having a low breakdown voltage; which does not require special ballast devices; and which has a relatively high efficiency.

It is still an object of the present invention to provide a new high pressure mercury-quartz lamp with a low breakdown voltage; which does not require special ballast devices; which has a stable ignition mode, and a relatively higher efficiency.

It is still an object of the present invention to provide a new super high pressure mercury lamps with a low breakdown voltage and stable ignition mode, which do not require special ballasts, and which are highly efficient.

It is still another object of the present invention to provide a new low pressure sodium lamp having a low breakdown voltage; which do not require special ballasts; and which have a stable ignition conditions.

It is still another object of the present invention to provide a new super high pressure gas lamp having a low breakdown voltage; which do not require special ballast devices; and with higher efficiency.

It is yet another object of the invention to provide a spectral lamp with a low breakdown voltage, which does not require a special ballast, with short stabilization time of the electrical and light characteristics; and which has a high efficiency.

Briefly, the above and further objects and the method of attaining them are satisfied by a new low breakdown voltage gas discharge device which includes an envelope filled with an appropriately selected working substance. Two main electrodes are sealed in a vacuum-tight manner inside the envelope, and are separated by a predetermined distance. A supplemental electrode extends between the main electrodes along the direction of the electrical discharge, and has its geometrical and electrical parameters satisfy the following equation:

$$S=I_d/C,$$

where S is the surface area of the supplemental electrode and depends on the distance between the main electrodes, $I_d$ is the current flowing in the supplemental electrode during normal glow discharge, and C is a constant characterizing the current $I_d$, the composition of the supplemental electrode, and the type and pressure of the working substance.

The supplemental electrode is connected to an AC or DC power source via a switch, so that the supplemental electrode always acts as a preparatory glow discharge cathode. The gas discharge device can be used in several applications, including voltage stabilizers, gasotrons, noise generators, gas-discharge light devices, neon lamps, low pressure fluorescent mercury lamps, high pressure fluorescent mercury lamps, bactericidal lamps, eritem lamps, high pressure mercury lamps, high pressure mercury-quartz lamps, super high pressure mercury-quartz lamps, super high pressure gas lamps, low and high pressure sodium lamps, metal-halide lamps, and spectral lamps. In applications using glow discharge, the present device will not require any reactive ballast, and therefore will not adversely affect the quality of the power supply.

BRIEF DESCRIPTION OF THE DRAWINGS

The above and other features of the present invention and the manner of attaining them, will become apparent, and the invention itself will be best understood, by reference to the following description and the accompanying drawings, wherein:

FIGS. 13 through 17 are schematic representations of another embodiment of a gas discharge device according to the present invention;

DETAILED DESCRIPTION OF THE PREFERRED EMBODIMENTS

I. Gas-discharge Devices

As it will be described later in exemplary applications, the low breakdown voltage gas-discharge devices according to the present invention generally include a gas-discharge bulb and an electrical circuit which can be internally or externally located relative to the bulb. The bulb is filled with a working substance, and is made of an opaque or optically transparent material which can optionally be coated or treated. At least two main electrodes, i.e., a cathode and an anode, and at least one supplemental electrode are located and hermetically sealed within the bulb. The supplemental electrode extends partially or completely between the anode and the cathode along the direction of the electric discharge axis.

The geometric and electric parameters of the supplemental electrode are correlated by the following equation:

$$S=I_d/C, \quad [1]$$

where S is the surface area of the supplemental electrode, which depends on the distance between the cathode and the anode. $I_d$ is the current of the normal glow discharge in the supplemental electrode. "C" is a constant which is empirically determined, and which characterizes the current density of the normal glow discharge, material of the supplemental electrode, and type and pressure of the working substance.

Every electrode terminates in at least one lead for connection to the electrical circuit. In some embodiments of the gas discharge device, the supplemental electrode can be made of two or more electrically conducting sections that are separated from each other. For example, in the embodiment including two sections only, each section includes an internal end and a distal end, such that both internal ends face each other and form a gap therebetween within the lamp working area, while each of the two distal ends terminates in an output lead or is connected to the main electrodes. The structure, type and design of the main electrodes, power supply, etc., and the separation, the design and placement of the internal ends of the supplemental electrodes are selected in such way that autoelectronic emission will occur. If the gas-discharge device has a long bulb, it can also be provided with at least one intermediate main electrode, in addition to the main electrodes.

Figure 1:
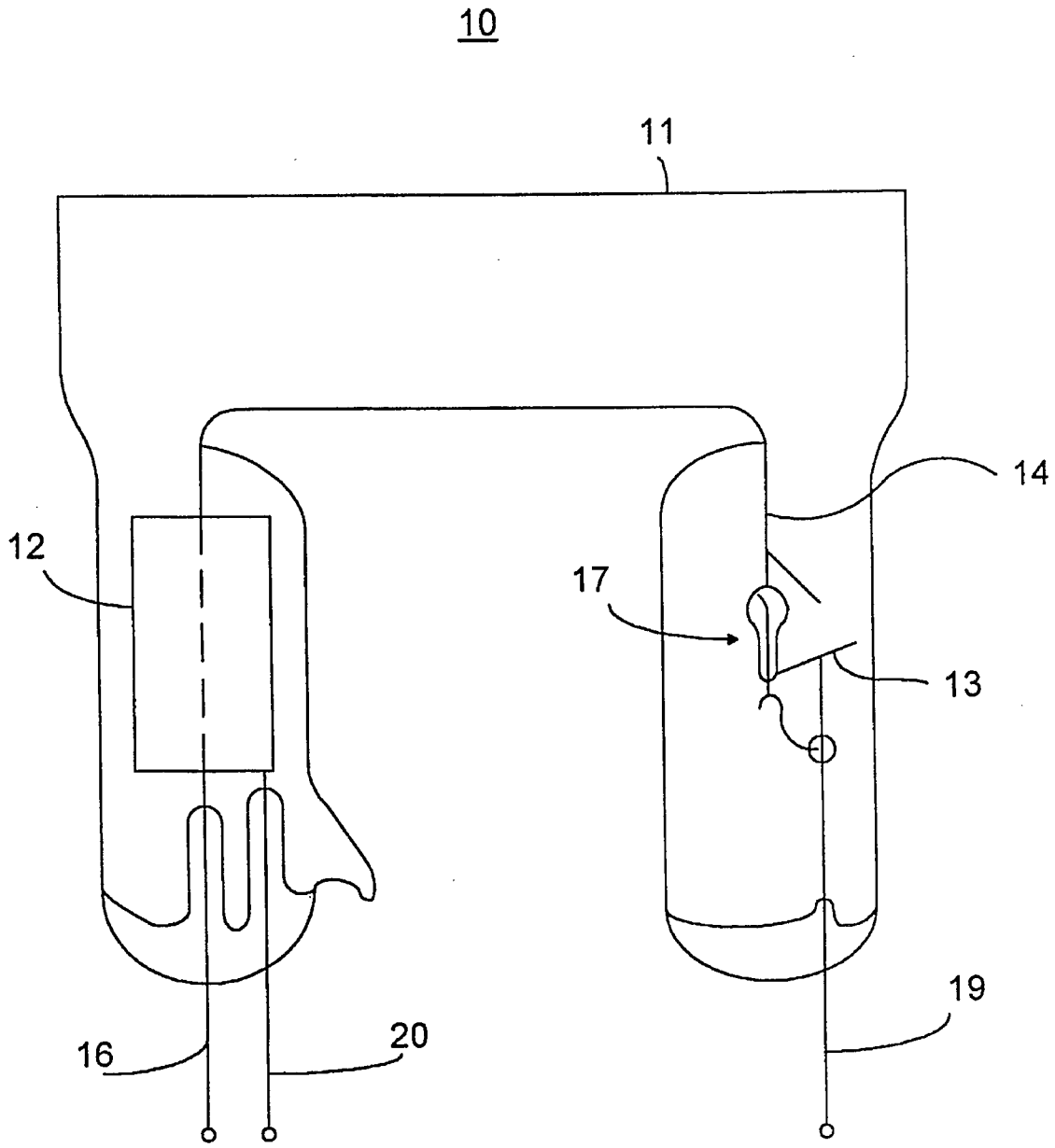
FIGURE 1 PRIOR ART
FIG. 1 is a schematic side elevational view of a conventional gas discharge device.
Figure 2:
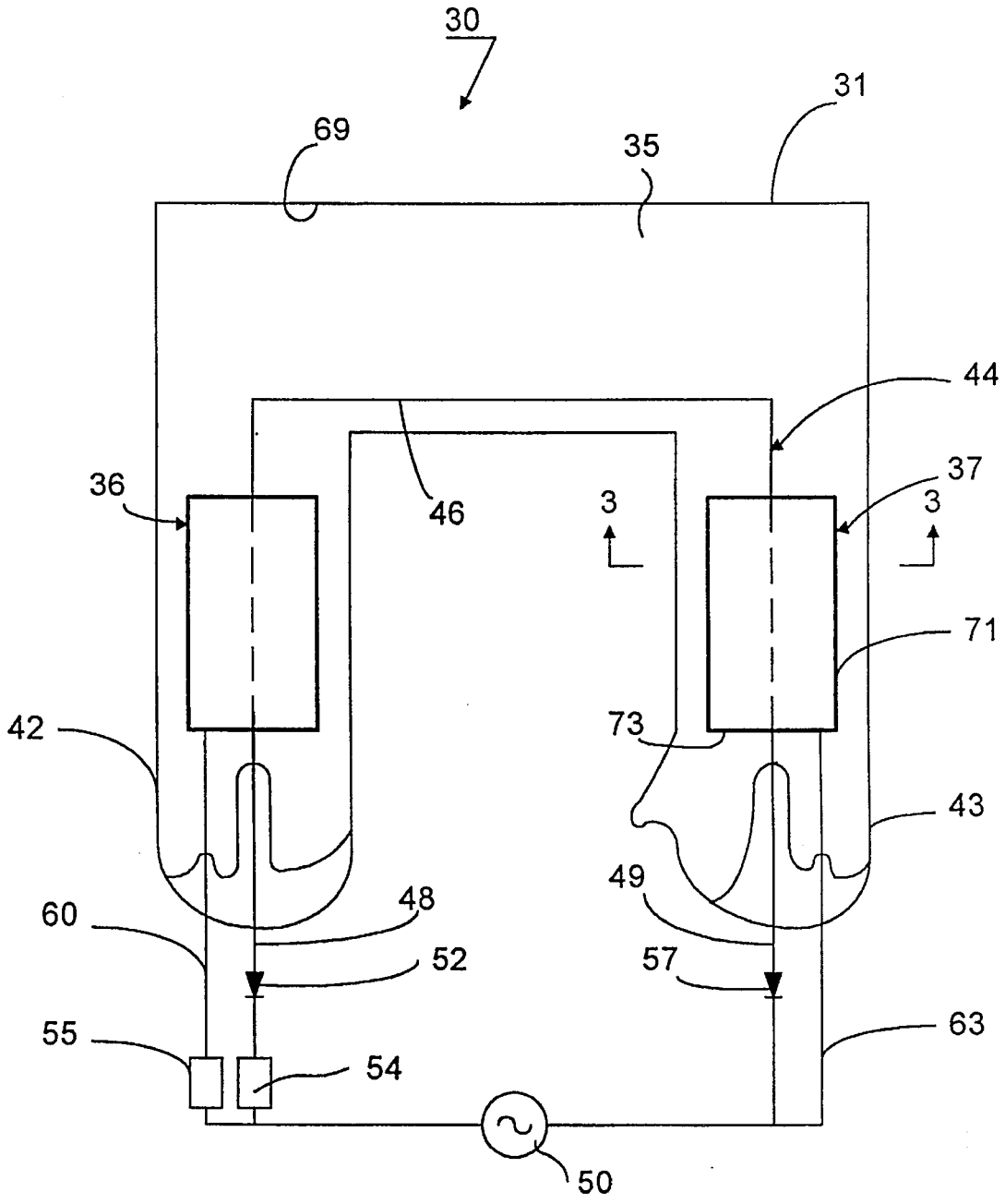
FIG. 2 is a schematic side elevational view of a preferred embodiment of a gas discharge device according to the present invention.

Referring now to the drawings, and more particularly to FIG. 2 thereof, there is illustrated a schematic side elevational view of a preferred embodiment of a gas discharge device 30, which is constructed according to the present invention. The device 30 has several applications. For instance, it can be used in several applications, including without limitation, voltage stabilizers, gasotrons, noise generators, gas-discharge light devices, neon lamps, low pressure fluorescent mercury lamps, high pressure fluorescent mercury lamps, bactericidal lamps, eritem lamps, high pressure mercury lamps, high pressure mercury-quartz lamps, super high pressure mercury-quartz lamps, super high pressure gas lamps, low pressure sodium lamps, spectral lamps, and a multitude of other applications.

The device 30 includes a bulb, vessel or envelope 31, which can be optically transparent or non-transparent depending on in the intended application. The envelope 31 is sealed in a vacuum-tight manner and contains an ionizable working substance. In a particular application of the present invention, when the device 30 is used as a gas discharge radiation device, such as a light source, for replacing fluorescent lamps, the working substance can be any type of inert gas and mercury vapor currently used in fluorescent lamps.

When the device 30 is used as a gas discharge device, such as a gasotron, stabilitron or noise generator, the envelope 31 can be optically transparent or non-transparent. For instance, the envelope 31 can be made of a ceramic, metallic and glass material.

The device 30 further includes two generally identical main electrodes 36 and 37 that are distally disposed at opposite ends 42 and 43 of the envelope 31, respectively. A conductive supplemental electrode 44 includes a main filament 46, which terminates into two insulated terminal leads 48 and 49.

The terminal lead 48 is connected to an alternating power (AC) source 50 via a diode 52 and a resistive load, such as a resistor 54. The terminal lead 49 is connected to the power source 50 via a diode 57. The first main electrode 36 is connected to a lead 60, which, in turn, is connected to a resistive load 55 and to the resistive load 54. Similarly, the second main electrode 37 is connected to a lead 63, which is connected to the power source 50.

In operation, when an input AC voltage is applied between the main electrode 37 and the resistive loads 54, 55, one of the main electrodes 36 or 37 becomes negatively charged, while the other main electrode becomes positively charged. For instance, during the first half cycle of the AC voltage, the main electrode 37 is negatively charged, and acts as a cathode, while the other main electrode 36 is positively charged, and acts as an anode.

As a result, the diode 57 is in a conductive state, i.e. switched ON, while the diode 52 is non conductive, i.e. switched OFF. The supplemental electrode 44 becomes negatively charged, via the diode 57, and acts as a preparatory discharge cathode, and a discharge current $I_d$ is caused to flow therethrough. The preparatory discharge starts between the anode main electrode 36 and the preparatory discharge cathode (supplemental electrode) 44, and thereafter spreads along the length of the preparatory discharge cathode 44, toward the cathode 37, and initiates the main discharge within a discharge chamber 35, between the main electrodes 36 and 37.

When the polarity of the input voltage is reversed, the roles of the main electrodes 36, 37 are also reversed. In the above example, the main electrode 36 becomes negatively charged, and acts as a cathode, while the other main electrode 37 becomes positively charged, and acts as an anode. As a result, the diode 52 is in a conductive state, i.e. switched ON, while the diode 57 is non conductive, i.e. switched OFF. However, the supplemental electrode 44 remains negatively charged, thus still acting as a preparatory discharge cathode, and a discharge current $I_d$ is caused to flow therethrough. Thus, once the working substance within the discharge chamber 35 is ionized, the main discharge is maintained between the main electrodes 36 and 37. This letter feature is applicable when a cathode is oxidized. Complete deionization of charges takes place when a cathode is metallic, and the fire processes do not affect processes in the next half-wave.

The gas discharge device 30 will now be described in greater detail in relation to FIG. 2. The envelope 31 according to the preferred embodiment is elongated and tubular, and has a generally U shape. The dimension of the envelope 31, such as its axial length, cross sectional diameter, thickness, shape, etc. vary significantly with the use application of the device 30.

The opacity of the envelope 31 can be selected to better suit the application of the gas discharge device 30. For instance, the envelope 31 can be made of glass, glass-ceramic composition, or metal-glass-ceramic composition. In some applications, the inner surface 69 of the envelope 31 is coated with an appropriate coating, made of phosphor, enamel, phosphor (luminophor), lacquer, or paint or other adequate material. In other applications, the envelope 31 is either partially coated or not coated at all. The envelope 31 is filled with the working substance, and is hermetically sealed by conventional methods.

It should be understood to those skilled in the art that the envelope 31 could have other shapes, dimensions and composition, without departing from the scope of the invention. For instance, as described below, the envelope 31 can have a straight or linear shape in order to replace fluorescent lamps. Alternatively, as will be described later, the gas discharge device 30 can have the shape of a light bulb in order to replace incandescent lamps.

Furthermore, the gas discharge device 30 can be custom shaped to replace neon lamps. Other shapes of the envelope are also contemplated within the scope of the present invention. Depending on the application or use, the envelope 31 can be very short (i.e. miniaturized), or very long. The principle of the invention supports the use of various lengths and shapes of the envelope.

The main electrodes 36 and 37 are generally identical, and therefore, only the main electrode 37 will be described in greater detail. The main electrode 37 is generally cylindrically shaped, and includes a hollow tubular wall 71, which is connected to a base 73. Since the main electrode 37 acts as a cathode, it should have the largest possible area, since a larger cathode area provides more current for the glow discharge to occur during the normal drop of the cathode potential.

The cylindrical shape of the main electrode 37 will provide it with a large surface area, and consequently a lower breakdown voltage is needed to ignite the gas discharge device 30. In order to lower the ignition and supply voltages, an appropriate working substance, i.e., mixture of gases must be selected. The ionization coefficient and the secondary emission coefficient depend on the selection of the electrodes composition and coating material. In one embodiment of the gas discharge device 30, the main electrodes can be spirally-shaped in order to provide a large working surface.

The base 73 is generally flat, and disc shaped, and includes a central opening (not shown), through which the supplemental electrode 44 passes. The opening is generally circular, and allows the supplemental electrode 44 to pass therethrough without touching the main electrode 37. The base 73 constitutes an integral structure with the wall 71 so as to form a unitary main electrode, i.e., 37.

The main electrode 37 is conductive, and as a result, the wall 71 and the base 73 are made of an appropriate electrically conductive material. While particular shapes and dimensions for the preferred embodiment have been described, it should be understood that, depending on the nature of the application and use, the gas discharge device 30 can assume different shapes, sizes, and compositions.

The main electrodes 36 and 37 are connected to insulated leads 60 and 63, respectively. The leads 60 and 63 are generally identical, and therefore, only the lead 63 will be described in more detail. The lead 63 is connected to the main electrode 37 by means of conventional means, such as by welding. The lead 63 is made of conductive material, and extends outside the envelope 31, for connection to the power source 50.

In designing the elements of the gas discharge device 30, if the working substance contains mercury vapors, it would be preferable not to use materials which, when exposed to mercury, form amalgams in the sputtered state, thus reducing the pressure of the working substance. It would be acceptable to use steel annealed in hydrogen for manufacturing the main electrodes. In one exemplary embodiment, the working substance used is gas-argon under pressure of 266.64–533.29 Pa, and mercury vapors.

The supplemental electrode 44 is shaped as a wire and is made of steel annealed in hydrogen, or another conductive material. In the embodiment shown in FIG. 27, the supplemental electrode is deposited on an insulated surface (or substrate) such as the envelope. The design parameters of the supplemental electrode 44 (length, diameter, width, material, etc.) are selected according to Equation [1] above. The design parameters of the supplemental electrode 44 form an important aspect of the operation of the gas discharge device 30 according to the present invention. When designing the supplemental electrode 44, it is advisable to select materials with low values of sputtering coefficient and constant C in Equation [1] above. The design parameters of the supplemental electrode 44 form an important aspect of the operation of the gas discharge device 30 according to the present invention. When designing the supplemental electrode 44, it is advisable to select materials with low values of sputtering coefficient and constant C in Equation [1] above.

The selection of the surface area of the supplemental electrode 44 is such that the device 30 satisfies optimal ignition conditions, and is an important part of the design of the inventive gas discharge device 30. For illustration purpose, if the supplemental electrode has a circular cross-section, then S is expressed by the following equation [2]:

$$S=\pi\times D\times L \qquad [2]$$

Then the diameter D of the supplemental electrode 44 is expressed by the Following equation [3]:

$$S=Id/(\pi\times C\times L) \qquad [3]$$

wherein L is the distance between the cathode and the anode.

It should become clear that the main filament 46 could assume various different cross sectional shapes. For instance, the cross section could be circular, square, oval, flat or any other appropriate shape.

One of the parameters characterizing the cathode area of a normal glow discharge is the current density in the supplemental electrode 44. For a predetermined composition and surface of the supplemental electrode 44, and for a predetermined type of the working substance, the current density in the supplemental electrode 44 is constant, and can be determined, for example, from the reference data provided by I. L. Kaganov, *Ion Devices,* M. Energy, 1972, pages 136–137, 196–198.

The constant current density ensures the spreading of the cathode region along the length of the preparatory cathode 44. This current density is constant and is defined as the current per unit of surface area of a conductor. The constant current density is one of the characteristics of glow-discharge devices. An increase in the discharge current $I_d$ is desirable until the entire length of the filament 46 is covered by the cathode area. Visually, the process is characterized by the spreading of the luminous "cover" embracing the supplemental electrode 44. Under these conditions, the main discharge starts in the chamber 35, between the main electrodes 36 and 37.

By selecting the proper sectional surface area S of the supplemental electrode 44, it would be possible to control the breakdown voltage and, therefore, the consumed voltage and light energy. For instance, if the filament surface area is relatively large, the discharge spreading will require a relatively high voltage at the filament during the build-up of the supply voltage amplitude, which delays the ignition and shortens the device life since the quenching voltage remains constant.

If a coded signal, such as a sequence of pulses with different widths (the pulse width significantly exceeding the supply voltage period), is applied across the filament 46, the discharge device 30 will generate radiation (or light energy) in accordance with the coding signal.

The ignition of the device 30 by the discharge on the supplemental electrode 44 requires a relatively small breakdown voltage and the transit steps in the glow discharge of the device 30 do not cause substantial noise or radio interference. For the same reason, the useful life of the device 30 is extended, since the glow discharge does not involve processes or steps which prematurely destroy the main electrodes or cause them to deteriorate.

The distance or separation between the supplemental electrode 44 and the main electrode 37 is small, and the potential gradient at the supplemental electrode 44 is high (the point-plane discharge type), the discharge between the supplemental electrode 44 and the main electrode 37 is ignited almost instantly, each time, at the same voltage. Sufficient gas ionization in the discharge chamber is ensured by the stable parameters of the preparatory discharge, the main discharge breakdown voltage is also practically stable.

In order to reduce the stroboscopic effect (flickering), it would be necessary to properly design the gas discharge device 30 by adequately selecting the geometrical parameters and composition of the supplemental electrode 44 and the main electrodes 36 and 37.

As mentioned earlier, the supplemental electrode 44 includes the main filament 46, and the terminal leads 48 and 49. The main filament 46 extends between the main electrodes 36 and 37 in the direction that coincides with the direction of electric discharge axis. Similarly to the envelope 31, in the present example, the main filament 46 is U shaped. It passes through the central opening of the base 73, and extends through, and substantially coaxially with the wall 71 of the main electrode 37. The main filament 46 further extends through the entire discharge space or chamber 35, and passes through the main electrode 36, such that the overall structure of the envelope 31 and the enclosed elements, is symmetrical with respect to a hypothetical orthogonal plane that passes through the middle of the envelope 31. It should be clear that a non symmetrical configuration of the gas discharge device 30 is also contemplated within the scope of the invention.

II. Voltage Stabilizers

In one application, the gas discharge device 30 and/or other gas discharge devices which will be described later, can be used as a voltage stabilizer. The voltage stabilizer according to the present invention can have for example, a glass, glass-ceramic or ceramet (ceramic-metal) bulb. The bulb is filled with proper gases, vapors or mixtures thereof. The main electrodes 36, 37 (anode and cathode) are placed inside the bulb, and the supplemental cathode 44 extends between the main electrodes 36 and 37 (anode and cathode) in the direction that coincides with the direction of electric discharge axis. The parameters of the supplemental electrode 44 satisfy Equation [1] above.

The use of supplemental electrode reduces the difference between the breakdown voltage and the maintaining voltage. It increases the useful life span and efficiency of the voltage stabilizer. The use of the supplemental electrode 44 enable the implementation and design of a gas discharge device, or as in this particular application a voltage stabilizer, in order to increase the distance between the main electrodes 36 and 37 ("discharge distance"). The increase of the discharge distance causes a higher potential fall in the positive column, which, in turn, results in an increase in the stabilizing voltage. In order to have a relatively high stabilizing voltage the length of the bulb of the lamp can be increased (i.e., the bulb is long), or the cross-section area of the bulb is decreased somewhere along the length of the bulb, preferably around its middle.

III. Gasotrons

In another application, the gas discharge device 30 and/or other gas discharge devices which will be described later, can be used as a gasotron. The gasotron according to the present invention can have for example, a glass, glass-ceramic or ceramet bulb. The bulb is filled with proper gases, vapors or mixtures thereof. The main electrodes 36, 37 (anode and cathode) are placed inside the bulb, and the supplemental cathode 44 extends between the main electrodes 36 and 37 in the direction that coincides with the direction of electric discharge axis. The parameters of the supplemental electrode 44 satisfy Equation [1] above.

The supplemental electrode 44 stabilizes the breakdown voltage, and reduces the difference between the breakdown voltage and the maintaining voltage. It reduce cathode sputtering, thus increasing the useful life span of the gasotron. The supplemental electrode 44 allows the anode current to be controlled by changing the voltage on the supplemental electrode 44, such as by changing the value of supplemental electrode current limiting resistor.

IV. Noise Generators

In yet another application, the gas discharge device 30 and/or other gas discharge devices which will be described later, can be used as a noise generator. The noise generator according to the present invention can have for example, a glass, or glass-ceramic bulb. The bulb is filled with an inert gas, such as neon or argon. The main electrodes 36, 37 and the supplemental electrode 44 are hermetically sealed inside the bulb. The parameters of the supplemental electrode 44 satisfy Equation [1] above.

V. Gas-discharge Light Devices

The low breakdown gas discharge device 30 can alternatively be used as a low breakdown voltage gas discharge light device according to the present invention. As such, it generally include a gas-discharge lamp and an electrical circuit which can be internally or externally located relative to the bulb. The bulb is filled with a working substance, and is made of optically transparent material which can optionally be coated or treated.

At least two main electrodes 36 and 37, and at least one supplemental electrode 44 are located and hermetically sealed within the bulb. The supplemental electrode 44 extends partially or completely between the anode and the cathode along the direction of the electric discharge axis. The parameters of the supplemental electrode 44 satisfy Equation [1] above.

Every electrode terminates in at least one lead for connection to the electrical circuit. In some embodiments of the gas discharge device, the supplemental electrode can be made of two or more electrically conducting sections that are separated from each other. For example, in the embodiment including two sections only, each section includes an internal end and a distal end, such that both internal ends face each other and form a gap therebetween within the bulb working area, while each of the two distal ends terminates in an output lead or is connected to the main electrodes. The ends of conducting electrodes that have a gap are placed in such a way that there is autoelectronic emission between them. If the gas-discharge device has a long bulb, it can also be provided with at least one intermediate main electrode, in addition to the main electrodes.

The following features of the gas discharge light device according to the present invention has the following features: It can be used in various applications, with different types of discharge, i.e., glow, arc, spark or with a hollow cathode), different types of cathodes, i.e., cold, hollow, or incandescent, different designs of the cathode, i.e., shape, configuration, dimensions, composition and materials, different types of working substances, i.e., gases, vapors, or mixture thereof, different pressures of working substances, different bulb designs, i.e., shape, configuration, dimensions, materials, coatings and treatments, different types of power supply voltages, i.e., DC, AC, pulsating, pulse, or high frequency, different types of ballasts and current limiting resistors.

VI. Neon Lamps

Figure 4:
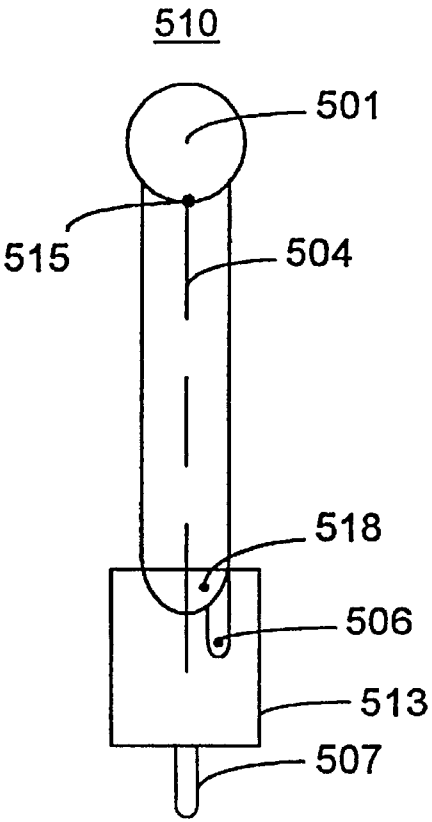
FIGS. 3 through 5 are schematic representations of other embodiments of a gas discharge device according to the present invention.
Figure 3:
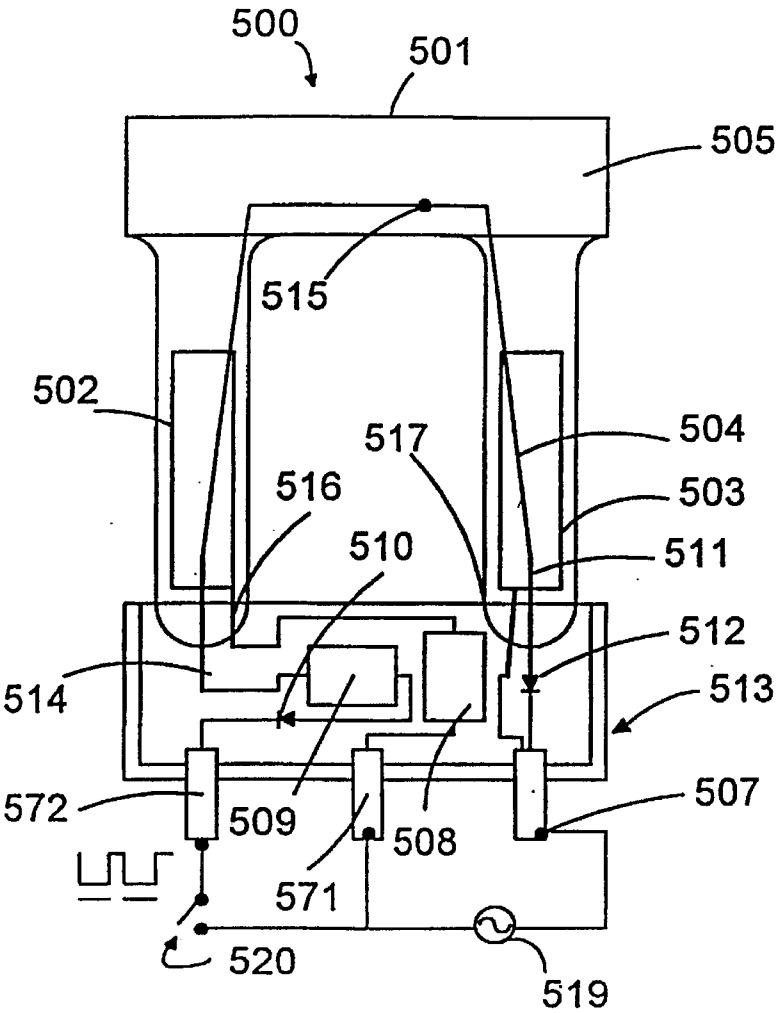
Figure 5:
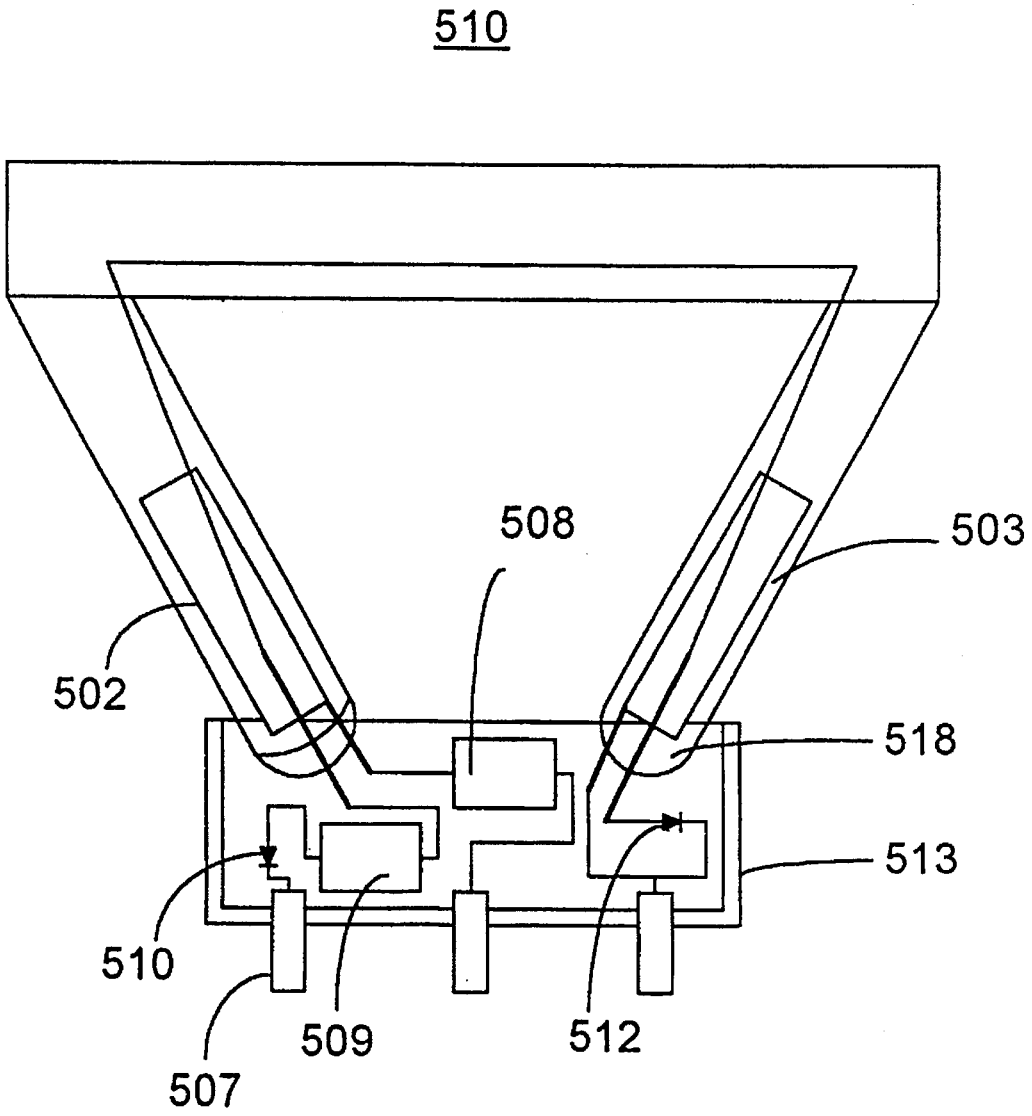

FIGS. 2, 3, 4 and 5 illustrate various designs for gas discharge light sources which generate an output of data and color information. The gas discharge light sources or lamps 500 and 510 shown in FIGS. 3 and 5 are generally similar in construction and design, with the exception of the working length of the bulbs. The lamps 500 and 510 can be assembled in line or in stack.

Each of the lamps 500 and 510 includes an envelope or bulb 501, that has been pumped out of air and filled with a proper gas such as neon. The bulb 501 is hermetically sealed, and contains two identical main electrodes, such as the main electrodes 502 and 503 and a supplemental electrode 504 (FIG. 3). The supplemental electrode 504 is dimensioned according to the parameters of Equation [1] above. The main electrodes 502 and 503 are made, for instance, as hollow cylinders terminating in leads 516 and 517, respectively. The lamp 500 includes what is referred to herein as "working area" 505, which in the present example is illustrated as the horizontal part of the envelope 501. The working area 505 is coated with phosphor, having the required color of radiation, and can be made of an optically material without coating. In some applications, the envelope 501 does not have a coating (i.e., when using the neon discharge).

The lamps 500 and 510 have identical sockets 513 containing electrical components, such as the resistors 508 and 509, and the diodes 510 and 512, and a plurality of pins 507, for connection to a receptacle (not shown), or to an alternating power source (not shown). Alternatively, the above electrical components could be located in the receptacle, which can be fixed to a control panel or indicator board (not shown). The resistors 508 and 509 are designed to limit the current at the main electrodes 502 and 503, and the supplemental electrode 504. The switches or diodes 510 and 512 are designed to cause the filament 504 to remain at a negative potential during the entire lamp operation. The supplemental electrode 504 can be a thin conductive film disposed or coated on a separate element (such as a partition) placed inside the bulb 501, or, in the alternative it can be deposited on the bulbs 501 or 511.

Figure 7:
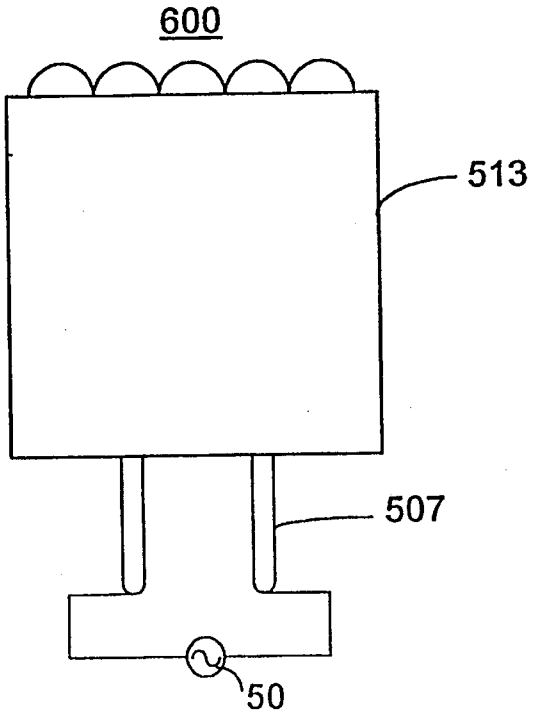
FIGS. 6 and 7 are schematic side elevational views of yet another embodiment of a gas discharge device according to the present invention.
Figure 6:
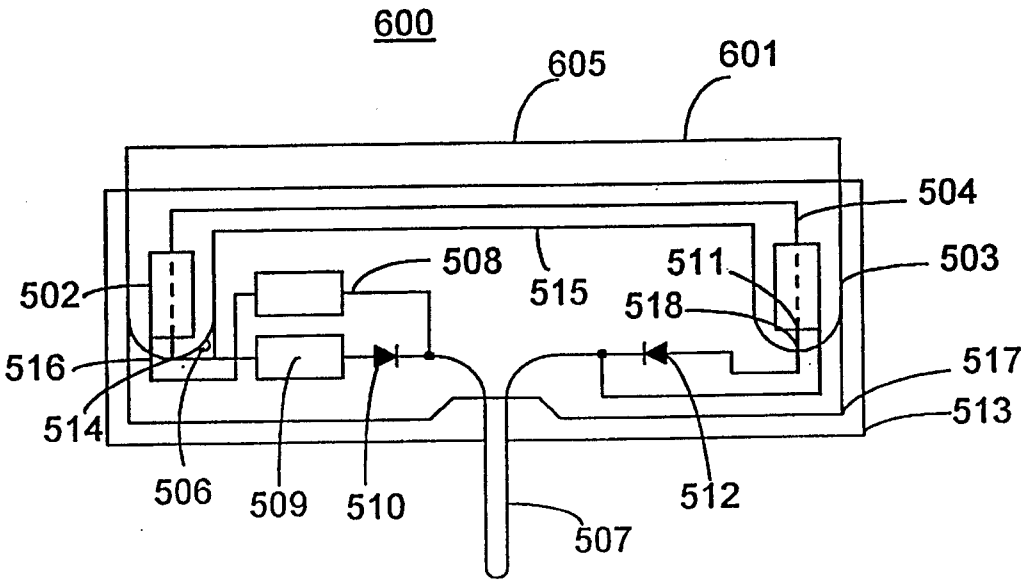

FIGS. 6 and 7 illustrate a gas-discharge light device 600 which differ from the lamps 500 (FIG. 3) and 510 (FIGS. 4 and 5) only by the shape of its bulb 601. The lamp 600 can be assembled in stack and can operate as an independent light source.

For illustration purposes, the exemplary neon 500, shown in FIG. 3, operates according to the following steps: When for example, an alternating voltage is applied, the lead 507 is at a positive potential, the switch (or diode) 512 is turned OFF, and the switch (or diode) 510 allows the supplemental electrode 504 to be at a negative potential. When the switch 520 is closed, the discharge is initiated between the electrode 503 and the supplemental electrode 504 with an increase in the voltage amplitude, and the discharge spreads along the length of the supplemental electrode 504, and covers the discharge chamber between the main electrodes 502 and 503. The main discharge starts in the lamp.

When the polarity of the supply voltage is reversed, the switch (or diode) 510 is turned OFF, and the switch (or diode) 512 is in a conductive state. The above discharge process is reversed, and spreads from the electrode 502 in the direction of the electrode 503.

If the switch 520 is open, and the electrode 502 receives a coded signal, i.e. a series of negative pulses, such that the width or duration of each pulse exceeds the period of the power supply voltage, and the amplitude is sufficient for the discharge to spread along the length of the supplemental electrode 504, then the lamp 500 will operate in a unique mode for the transmission of coded light data.

As an example of the manufacturing process of the foregoing neon lamps, the manufacturing steps of the lamp 500 will now be described:

the bulb or envelope 501 is formed;

the main electrodes 502 and 503 are formed, for example, as hollow cylinders;

the supplemental electrode 504 is placed inside the bulb 501, and each of its two ends is connected to a corresponding lead, i.e., 511 and 514, with a part 515 of the supplemental electrode 504, within the working area 505 being in close contact with (or is alternatively deposited on) the inner surface of the bulb 501;

the main electrodes 502 and 503 with their corresponding leads 516 and 517 are placed within the bulb 501;

legs 518 are formed from the opened ends of the bulb 501 and the leads 516 and 517 of the main and supplemental electrodes 502, 503,504, with one of these legs having an exhaust tube 6.

the bulb 501 is connected to a pump (not shown) by means of the exhaust tube 6.

the bulb 501 is pumped out of air in accordance with conventional techniques for the manufacture of gas discharge devices;

the bulb 501 is filled with gas, for example, neon at a pressure of between about 2–4 mm Hg;

the bulb 501 is disconnected from the pump;

if a low breakdown voltage is required, the bulb 501 is filled with a gas mixture (Penning's mixture), and the surfaces of the main and supplemental electrodes are oxidized;

the bulb 501 is connected to the power supply and is burnt-in, while operational, until its parameters stabilize;

the external components of the electrical circuit are then connected to their corresponding leads in such a way that they could fit inside the socket (or connector block) 513, which is secured to the lamp;

The lead 514 of the supplemental electrode 504 is connected, through a resistor 509 and a switch (for example a diode) 510 to the lead 572 of the socket 513;

the other lead 511 of the supplemental electrode 504 is connected, through the switch (for example a diode) 512, to the lead 507 of the socket 513;

the lead 517 of the main electrode 503 is connected directly to the lead 507 of the socket 513; and the lead 516 of the main electrode 502 is connected, through a resistor 508 to the lead 571 of the socket 513.

In one exemplary embodiment, the gas-discharge devices illustrated in FIGS. 3 and 5 can have, for example, the following mechanical characteristics and composition:

1. The height of the device 500 or 510 is about 50–70 mm;
2. The diameter of the bulbs 501 or 511 is about 5–12 mm;
3. The length of the bulb working area 505 is about 50–100 mm;
4. The dimensions of the connector block or socket 513 are about 50×12×30 mm;
5. Materials/Composition:

the bulbs 501, 511 are made of glass like/type material having a coefficient of temperature expansion about equal to lead or platinum (hereafter referred to as lead or platinum group).

the main electrodes 502, 503 are made of carbon steel, annealed in hydrogen, and having a thickness of about 0.2–0.3 mm;

the supplemental electrode 504 is made for example, of wire (carbon steel), annealed in hydrogen, and having a diameter of about 0.2–0.3 mm;

the leads and connections are composed of a wire made of appropriate conductive material.

the gas can be, for example, neon at a pressure of about 2–4 mm Hg;

the power supply voltage can be, for instance, either 110 V, 127 V, 220 V or 380 V, with other voltages being also contemplated by the present invention;

the components of the electrical circuit: Resistor 508 (100–120 Ohms) with a power consumption P (2.0–3.0 W) Resistor 509 (1.0–1.5 kOhm) with a power consumption P(0.5 to 1.0 Watt); Switches or diodes 510, 512, $V_R$ not less than 400 V, $I_F$ not less than 100 mA.

VII. Low Pressure Fluorescent Mercury Lamps

The gas discharge device described herein can also be used as a low pressure fluorescent mercury lamp, which generally includes a gas discharge lamp and an electrical circuit, which can be internally or externally located relative to the bulb. The bulb is filled with a working substance, and is made of optically transparent material which can optionally be coated or treated. At least two main electrodes 36 and 37, and at least one supplemental electrode 44 are located and hermetically sealed within the bulb. The supplemental electrode 44 extends partially or completely between the anode and the cathode along the direction of the electric discharge axis. The parameters of the supplemental electrode 44 satisfy Equation [1] above.

Every electrode terminates in at least one lead for connection to the electrical circuit. In some embodiments of the gas discharge device, the supplemental electrode can be made of two or more electrically conducting sections that are separated from each other. For example, in the embodiment including two sections only, each section includes an internal end and a distal end, such that both internal ends face each other and form a gap therebetween within the bulb working area, while each of the two distal ends terminates in an output lead or is connected to the main electrodes. The ends of conducting electrodes that have a gap are placed in such a way that there is autoelectronic emission between them. If the gas-discharge device has a long bulb, it can also be provided with at least one intermediate main electrode, in addition to the main electrodes.

The low pressure fluorescent mercury lamp according to the present invention has the following features: It can be used in various applications, with different types of discharge, i.e., glow, arc, spark or with a hollow cathode), different types of cathodes, i.e., cold, hollow, or incandescent, different designs of the cathode, i.e., shape, configuration, dimensions, composition and materials, different types of working substances, i.e., gases, vapors, or mixture thereof, different pressures of working substances, different bulb designs, i.e., shape, configuration, dimensions, materials, coatings and treatments, different types of power supply voltages, i.e., DC, AC, pulsating, pulse, or high frequency, different types of ballasts and current limiting resistors.

When using the glow discharge, one of the parameters which characterizes the cathode area of the normal glow discharge is the current density on the cathode. With properly selected cathode material, and type and pressure of the working substance, the current density on the cathode is constant (Gel's law). This constancy insures the spread of the cathode area along the cathode surface.

The same rules apply to the discharge process relative to the supplemental electrode. This is why the constancy of the current density at the cathode provides the spread of preparatory discharge cathode area to the supplemental electrode. In the low pressure fluorescent mercury lamp that illustrated in FIG. 2, the supplemental electrode 44 is made as a thin metal filament. The increase of the discharge current $I_d$ is maintained until the discharge spreads along the entire length of the supplements electrode 44. Visually, the above discharge process resembles the spreading of the glow "envelope" along the length of the supplemental electrode 44 will not become comparable with distance between the electrodes 36 and 37. Once this condition is established, the main discharge, which provides the lamp functional capabilities, starts in the lamp area between the two main electrodes 36, 37.

FIG. 2 illustrates a general simplified schematic view of the gas discharge device 30 for use as a low pressure fluorescent mercury lamp according to the present invention, shown connected to an AC power source 50 (for example, 220 V). The lamp (or gas discharge device) 30 includes a bulb 31 which is filled with an appropriate working substance. The bulb 31 is made, for example, of glass; however other substances can alternatively be used, such as glass-ceramet or metal-glass.

The bulb 31 can be completely coated with a phosphor, or, alternatively, it can be partially coated with the phosphor material, such as where only the working area of the bulb 31 is coated. Other types of coating material can be used, for instance lacquers, paints, different compositions with metal or without metal, and glass treatment.

The main electrodes 36 and 37 are placed and hermetically sealed inside the bulb 31. The main electrodes 36 and 37 are formed in this particular illustration in the shapes of hollow cylinders. It should become clear that other shapes of the main electrodes 36 and 37 are also contemplated by the present invention. In this embodiment, the supplemental electrode 44 is made of a which extends between the main electrodes 36, 37, through the entire discharge area. The supplemental electrode 44 terminates in two leads 48 and 49. The electrical circuit includes an AC power supply; two current limiting resistors 54, 55, and two switches or diodes 52 and 57. The diodes 52, 57 cause the supplemental electrode 44 to remains at a negative potential during the lamp operation.

In operation, when a voltage is applied to the lamp (gas discharge device) 30, one of the main electrodes, such as the main electrode 36 becomes positively charged, and functions as an anode. The supplemental electrode 44 acts as a preparatory discharge cathode, while the main electrode 37 acts as the main discharge cathode.

If the supplemental electrode 44 were not included in the design of the present lamp 44 for igniting the lamp 30, it would have been necessary to apply a significantly high input voltage of several kilovolts between the two main electrodes 36, 37. For example, in order to ignite or start a discharge in the lamp having a length of 300 mm and a diameter of 10–12 mm the required breakdown voltage would have been about 2–5 kV. The breakdown voltage would be very unstable as a result of statistical ignition conditions (i.e., random, statistical variation of the breakdown voltage value).

In the present design, the discharge, with a discharge current $I_d$ starts between the anode 36 and the supplemental electrode 44. The intensity of the current depends on the parameters of the electrical circuit and the power supply of the lamp operation. The necessary and sufficient condition for reliable ignition of the discharge between the electrodes 36, 37 is the spread of the preparatory discharge cathode area along the entire surface of the supplemental cathode 44. In order to implement this condition the required discharge current Id becomes, using the law of constant current density of glow discharge:

$$I_d = \pi \times D \times L \times C = S \times C \qquad [4]$$

where S is the sectional area of the filament forming the preparatory cathode 44, D is the sectional diameter of the filament, and L is the effective length of the supplemental electrode, which is the distance covered by the discharge at a certain voltage between the main electrodes. The relationship in Equation [4] above defines the optimal geometrical parameters of the lamp design in order to obtain a stable breakdown voltage.

If, according to the working conditions of the lamp there is a need to have a small diameter of the supplemental electrode, then with all the other conditions and parameters remaining the same it would be possible to use a filament having a large diameter with a partially insulated surface. The surface of non-insulated portion area along the effective length of the filament length must be equal to $S=D \times L \times \pi$ of the required filament. It is noteworthy to mention that a filament having a small diameter limits the useful life of the lamp as a result of fast sputtering.

In this particular illustration, the cathode discharge area with a discharge current $I_d$ will cover the entire surface of the filament 46 forming the supplemental electrode 44 in the area between the two main electrodes 36, 37. The main discharge, providing functionality of the lamp and its light characteristics, will start between the anode 36 and the cathode 37.

When the polarity of the power supply voltage changes, all the processes in the lamp develop in a similar way, but the roles of the main electrodes 36 and 37 is reversed, and the main electrode 36 acts as the cathode, while the other main electrode 37 acts as the anode.

The two leads 48, 49 are insulated, and connect the filament 46 forming the supplemental electrode 44 to the diodes 52 and 57, respectively. When the lamp 30 is powered by an AC input voltage, the diodes 52 and 57 cause the filament 46 to act as a preparatory cathode during the entire operation of the lamp 30.

The foregoing design principles are used during the development of the gas discharge light device used to output numerical and color information. The gas discharge devices illustrated in FIGS. 2, 3, 4 and 5 can be used as low pressure fluorescent mercury lamps according to the present invention. These low pressure fluorescent mercury lamps differ only in that the design of the lamp illustrated in FIG. 2 does not have any imposed design restrictions, i.e., the bulb can have any shape. The lamps illustrated in FIGS. 3, 4 and 5 are made in such way that can be assembled in line or in a stack.

Each of the lamps 500 and 510 includes an envelope or bulb 501 that has been pumped out of air and filled with a proper gas such as argon and mercury vapor. The bulb 501 is hermetically sealed, and contains two identical main electrodes, such as the main electrodes 502 and 503 and a supplemental electrode 504 (FIG. 3). The supplemental electrode 504 is dimensioned according to the parameters of Equation [1] above. The main electrodes 502 and 503 are made, for instance, as hollow cylinders terminating in leads 516 and 517, respectively. The working area 505 is coated with phosphor, having the required color of radiation. In some applications, the envelope 501 does not have a coating (i.e., when using neon discharge).

The lamps 500 and 510 have identical sockets 513 or connection blocks (which can optionally contain the electrical components, such as the resistors 508 and 509, and the diodes 510 and 512), and a plurality of pins 507, for connection to a receptacle (not shown), or to an alternating power source (not shown). The receptacle can be mounted on a control panel or indicator board (not shown). The resistors 508 and 509 are designed to limit the current at the main electrodes 502 and 503, and the supplemental electrode 504. The switches or diodes 510 and 512 are designed to cause the filament 504 to remain at a negative potential during the entire lamp operation. The supplemental electrode 504 can be a thin conductive film disposed or coated on a separate element (such as a partition) placed inside the bulb 501, or, in the alternative it can be deposited on the bulb 501.

For illustration purposes, the exemplary lamps 500 and 510, shown in FIGS. 3 through 5, operate as follows: When for example, an alternating voltage is applied, the lead 507 is at a positive potential, the switch (or diode) 512 is turned OFF, and the switch (or diode) 510 allows the supplemental electrode 504 to be at a negative potential. When the switch 520 is closed, the discharge is initiated between the electrode 503 and the supplemental electrode 504 with an increase in the voltage amplitude, and the discharge spreads along the length of the supplemental electrode 504, and covers the discharge chamber between the main electrodes 502 and 503.

When the polarity of the supply voltage is reversed, the switch (or diode) 510 is turned OFF, and the switch (or diode) 512 is in a conductive state. The above discharge process is reversed, and spreads from the electrode 502 in the direction of the electrode 503. If the switch 520 is opened, and the electrode 502 receives a coded signal, i.e. a series of negative pulses, such that the width or duration of each pulse exceeds the period of the power supply voltage, and the amplitude is sufficient for the discharge to spread along the length of the supplemental electrode 504, then the lamp 500 will operate in a unique mode for the transmission of coded light data.

As an example of the manufacturing process of the foregoing low pressure fluorescent mercury lamps, the manufacturing steps of the lamp 500 will now be described:

the bulb or envelope 501 is formed;

the inside surface of the working area 505 of the bulb 501 is coated with phosphor of the required color of radiation or light emission;

the main electrodes 502 and 503 are formed, for example, as hollow cylinders;

the supplemental electrode 504 is placed inside the bulb 501, and each of its two ends is connected to a corresponding lead, i.e., 511 and 514, with a part 515 of the supplemental electrode 504, within the working area 505 being in close contact with (or is alternatively deposited on) the inner surface of the bulb 501;

the main electrodes 502 and 503 with their corresponding leads 516 and 517 are placed within the bulb 501;

legs 518 are formed from the opened ends of the bulb 501 and the leads 516 and 517 of the main and supplemental electrodes 502, 503,504, with one of these legs having an exhaust tube 6.

the bulb 501 is connected to a pump (not shown) by means of the exhaust tube 6.

the bulb 501 is pumped out of air in accordance with conventional techniques for the manufacture of gas discharge devices;

the bulb 501 is filled with gas, for example, argon at a pressure of between about 2–4 mm Hg and a dosed amount of mercury;

the bulb 501 is disconnected from the pump;

if a low breakdown voltage is required, the bulb 501 is filled with a gas mixture (Penning mixture), and the surfaces of the electrodes are oxidized;

the bulb 501 is connected to the power supply and is burnt-in, while operational, to its desired stabilization parameters;

the external components of the electrical circuit are then connected to their corresponding leads in such a way that they could fit inside the socket (or connector block) 513, which is secured to the lamp;

The lead 514 of the supplemental electrode 504 is connected, through a resistor 509 and a switch (for example a diode) 510 to the lead 572 of the socket 513;

the other lead 511 of the supplemental electrode 504 is connected, through the switch (for example a diode) 512, to the lead 507 of the socket 513;

the lead 517 of the main electrode 503 is connected directly to the lead 507 of the socket 513; and the lead 516 of the main electrode 502 is connected, through a resistor 508 to the lead 571 of the socket 513.

The low pressure mercury fluorescent lamps illustrated in FIGS. 3, 4 and 5 can have, for instance, the following mechanical characteristics and composition:

The height of the device 500 or 510 is about 50–70 mm;

The diameter of the bulb 501 is about 5–12 mm;

The length of the bulb working area 505 is about 50 mm (FIG. 3)–100 mm (FIG. 5);

The dimensions of the connector block or socket 513 are about 50×12×30 mm;

Materials/Composition:

the bulb 501 is made of glass for example, from the lead or platinum group;

the main electrodes 502, 503 are made of carbon steel annealed in hydrogen, and having a thickness of about 0.2–0.3 mm;

the supplemental electrode 504 is made of wire (carbon steel), annealed in hydrogen, and having a diameter of about 0.2–0.3 mm;

the leads and connections are made of a wire made of appropriate conductive material;

any type of phosphor material used with lamps (for illumination).

the gas can be, for example, argon at a pressure of about 2–4 mm Hg and a dosed amount of mercury;

the power supply voltage can be, for instance, either 220 V or 380 V with other voltages being also contemplated by the present invention;

the components of the electrical circuit are as follows: Resistor 508 (100–120 Ohms) with a power consumption P (2.0–3.0 W) Resistor 509 (1.0–1.5 kOhm) with a power consumption P(0.5 to 1.0 Watt); Switches or diodes 510,512, $V_R$ not less than 400 V, $I_F$ not less than 100 mA.

FIGS. 6 and 7 illustrate a gas discharge light device 600 for use as a low pressure fluorescent mercury lamp. This lamp 600 differs from the lamp 500 of FIG. 3 only by the shape of the bulb 601. The lamp 600 can be assembled in stack or in a line, and can be used as an independent light source.

FIGS. 8 through 11*b* illustrate another low voltage gas discharge light device 250 for use as a low pressure fluorescent mercury lamp according to the present invention.

The low pressure fluorescent mercury lamp 250 includes a glass bulb or envelope 251 having an elongated cylindrical shape. It is partially coated with phosphor, and filled with a mixture of argon and mercury vapor. The envelope 251 is generally divided into two identical chambers 258 and 259 by means of a partition 260. The partition 260 can be made of glass or ceramics, and makes a close contact with the bulb 251.

For this purpose, the envelope 251 and the base member or leg 228 of the lamp 250 have correspondent grooves or channels 220, 221 and 222. Two pins or wires 216 and 217 are soldered to the partition 260. The partition 260 can be integrally formed with the base member 228.

The envelope 251 contains two hermetically sealed main electrodes 252 and 253, which are semicylindrically shaped and which terminate into two leads 257 and 258, respectively. A supplemental electrode 254 is made of a thin wire filament, and terminates in two leads 259 and 261. The filament 254 is closely supported by the partition 260 and its terminal ends are affixed to the pins 216 and 217, which, in turn, are affixed to the leads 259 and 261 of the base member 228.

The electrode lead 257 is connected, via the resistor 411 (active load) to a connector 424, which is adapted to be connected to an AC power supply (not shown). The lead 259 is also connected to the connector 424, via the resistor 412 and a diode 414. The lead 258 and the lead 261 are connected, via the diode 413 to a screw-in base or connector 425.

When an alternating voltage is applied to the lamp 250 between the connectors 424 and 425, and for the first half cycle, the potential applied to one of these connectors is positive. For example purpose, the electrode 252 and the supplemental electrode 254 are at a negative (or lower) potential, and act as a main cathode and a preparatory discharge cathode, respectively, with the diode 414 being switched ON, and the diode 413 being switched OFF. The electrode 253 acts as an anode. The preparatory discharge is started between the anode 253 and the pin 217, and with an increase of the voltage amplitude the discharge spreads along the filament of the supplemental electrode 254, and then along the pin 216, and initiates the main discharge in the discharge chamber, between the two main electrodes 252 and 253.

When the polarity of supply voltage is reversed, the main electrode 252 acts as an anode, the main electrode 253 acts as a cathode and the filament of the supplemental electrode 254 again acts as a preparatory discharge cathode, with the diode 413 being switched ON, and the diode 414 being switched OFF. The main discharge is initiated between the two main electrodes 252 and 253 in a similar way as described above.

Figure 10A:
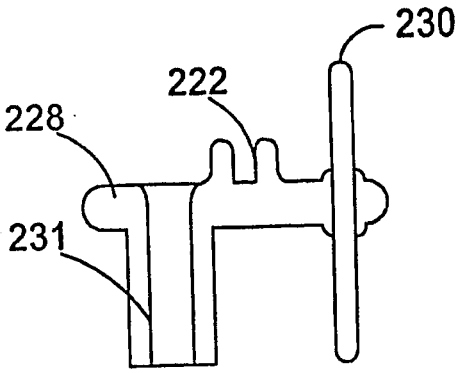
Figure 11A:
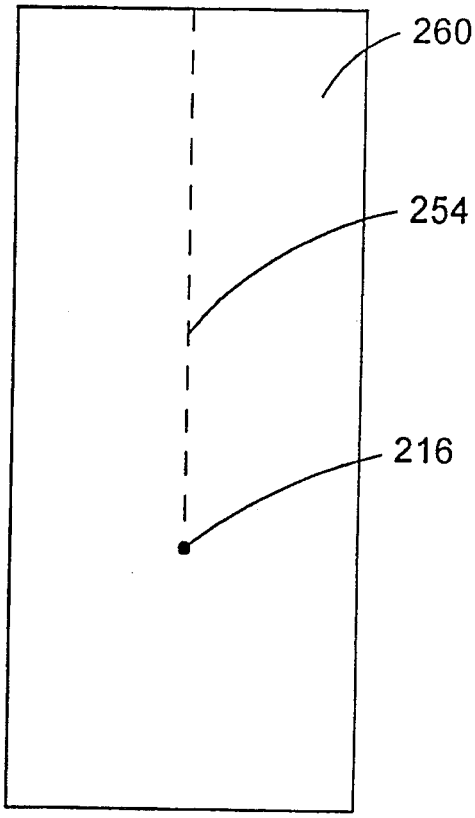
Figure 10B:
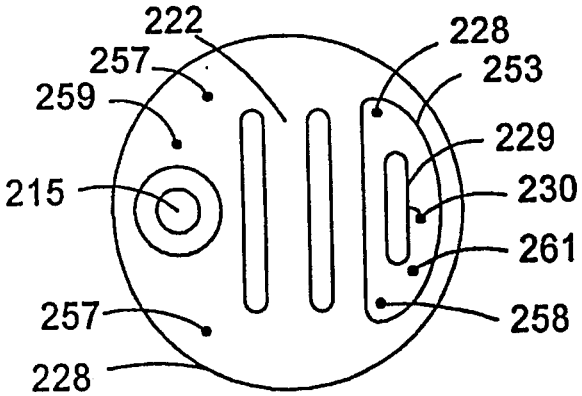
Figure 11B:
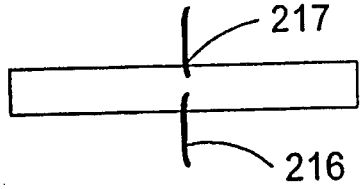

The lamp 250 is manufactured according to the following steps:

The base member 228 is formed as illustrated in FIGS. 10*a* and 10*b* (possibly with the partition 260) which has seven leads, a recess or groove 222, and an exhaust tube 215.

Figure 9A:
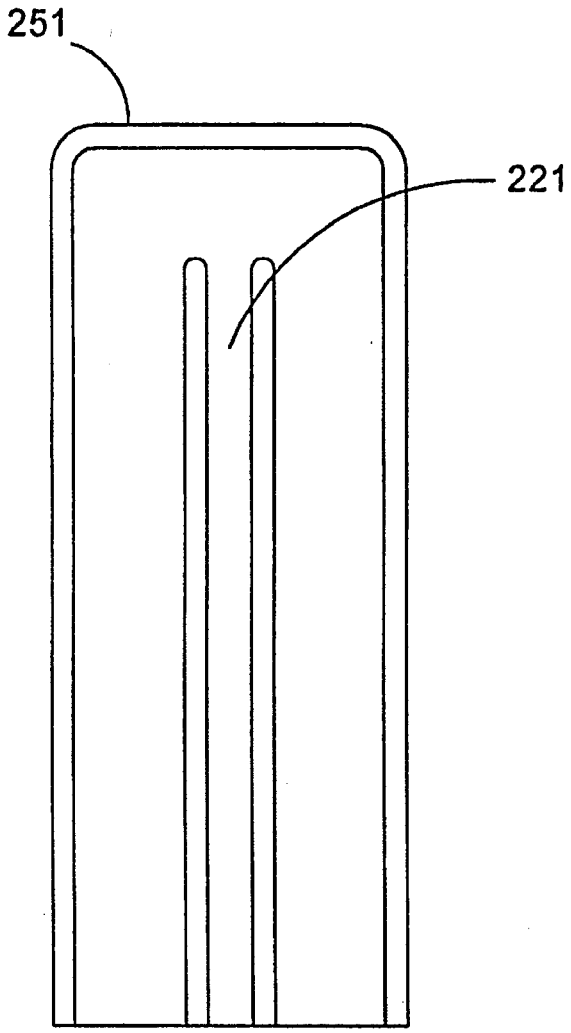
Figure 9B:
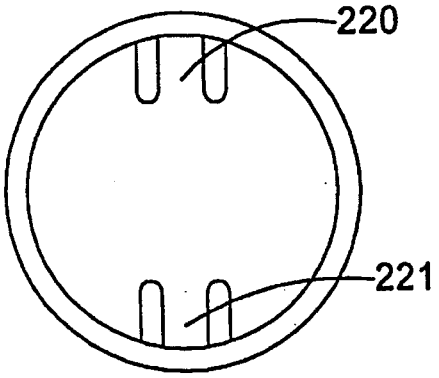

The bulb or envelope 251 is formed with the grooves 220, 221, as shown in FIGS. 9*a* and 9*b*, and is coated with phosphor;

the partition 260 is then formed, with the pins 216 and 217;

the main electrodes 252 and 253 are made in a generally hollow semicylindrical shape (with a bottom having holes, or without a bottom).

the filament of the supplemental electrode 254 is made of a piece of thin wire (the filament can alternatively be made by coating, spraying or sputtering a predetermined pattern of a conductive material on the partition 260, such that the ends of the filament are connected to the pins 216 and 217;

a plate-shaped mercury dispenser 229 is then made, and is attached to a lead 230 of the base member 228;

the electrodes 252 and 253 are connected to the correspondent leads of the base member 228;

the partition 260 is then inserted into the groove 222, and the pins 216 and 217 are connected to the corresponding leads of base member 228;

if a low breakdown voltage is required, the envelope 251 is filled with a mixture of gases (Penning's mixtures), and the surfaces of the main and supplemental electrodes are oxidized;

the envelope 251 is then assembled, such that the partition 260 fits in the corresponding grooves 220, 221 of the envelope 251;

the envelope 251 and the base member 228 are connected by conventional means, such as by welding;

the envelope 251 is connected to a vacuum pump (not shown), via the exhaust tube 215, and the envelope is pumped out according to well know techniques in the field;

the envelope 251 is filled with argon gas to a pressure between 2–4 mm Hg and disconnected from the vacuum pump according to standard technology;

the positive terminal of a DC power source with an adjustable output voltage varying from 200 to 600 V is connected to the electrode 252, and its negative terminal is connected to the lead 230, via a resistor (R=3 kOhm, P=5 W to 10 W); a discharge occurs for about 40 minutes between the dispenser 229 and the electrode 252, with a current density of about 20 mA/cm$^2$;

the electrical components, i.e., 411, 412, 413, 414 are connected to corresponding leads such that they fit within the adaptor 226 which is connected to the bulb 251;

a standard base 227 to the adaptor 226 such that the ends of the connectors 424, 425 pass through the corresponding holes in the base 227;

the ends or the connectors 424 and 425 are secured to the base 227, and the base 227 is attached to the adaptor 226; and the assembled lamp 250 is then connected to the power supply and burnt-in to its desired stabilization parameters.

Figure 12:
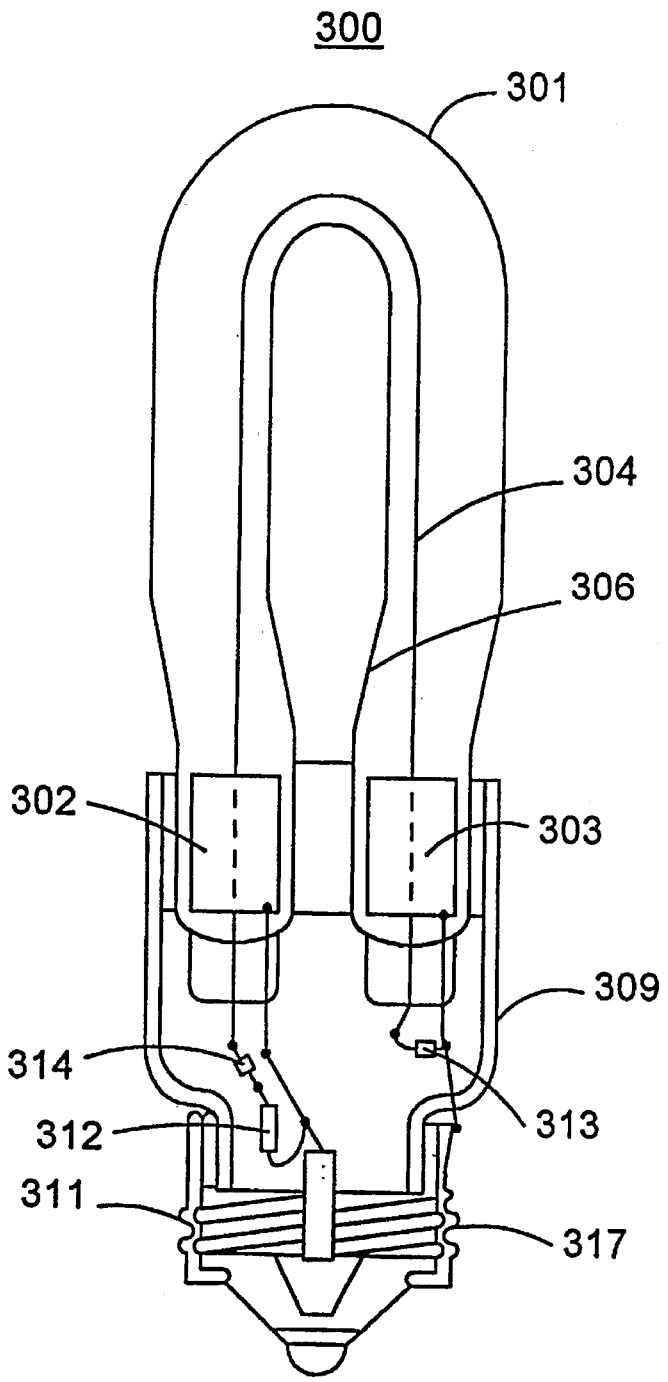
FIG. 12 is a schematic side elevational view of an additional embodiment of a gas discharge device according to the present invention.

Another embodiment of a low breakdown voltage gas discharge light device or lamp 300 is illustrated in FIG. 12. The lamp 300 is similar to the lamp 250 (FIG. 8), with the exception that both lamps 250 and 300 differ only in the shape of the bulb or envelopes.

FIGS. 13 through 17 illustrate yet another embodiment of a low breakdown voltage gas discharge radiation device 400 according to the present invention. In this particular application, the device 400 is used as a light source. The device 400 generally includes a lamp and an electrical circuit for operating the lamp when the latter is powered by an AC power source.

The lamp includes a hermetically sealed glass bulb or envelope 401 having an elongated cylindrical shape, which is partially coated with phosphor and filled with admixture of argon and mercury vapor. The lamp further includes two main electrodes (i.e., a cathode 402, and an anode 403) which terminate in leads 408 and 407, respectively, and a supplemental electrode 404. These three electrodes are hermetically sealed within the bulb 401.

Figure 13:
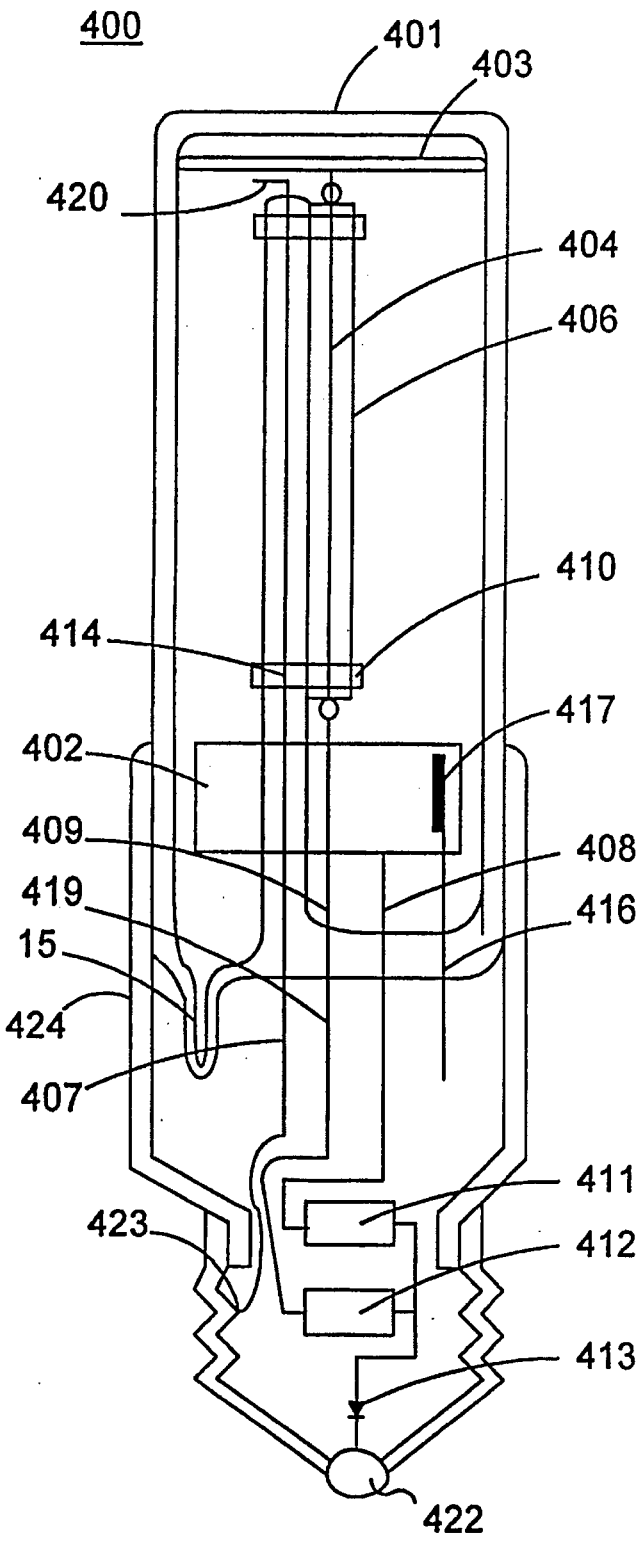

The supplemental electrode (preparatory discharge cathode) 404 is made of a thin wire (filament), whose mechanical attributes are selected to satisfy Equation [1] above. The filament terminates in a lead 419, and extends inside a cylindrical tube 406. The terminal ends of the filament are attached to a thin ceramic tube 414, which in turn is attached to a clamp 410 mounted on the tube 406, as illustrated in FIG. 13.

Figure 17:
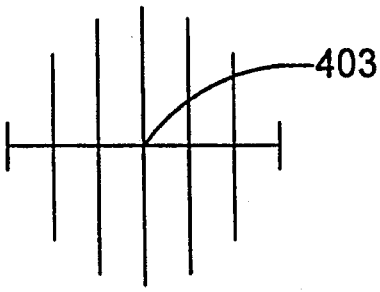

The anode 403 is made as shown in FIG. 17, and is attached to an electrode 420. The cathode 402 is made of a metal tape which is rolled in a flat helical shape, thus considerably increasing its effective surface, because both of the cathode surfaces or walls function as electron emitting surfaces. The cathode 402 terminates in a lead 408.

A dispenser 417 is placed inside the cathode 402 and terminates in a lead 416. The tube 406 and the filament of the supplemental electrode 404 are made as separate parts, as shown in FIG. 14. The tube 406 is attached to the electrode 420 by means of the clamp 410. The lamp is mounted on an adaptor 424 which contains the electrical components.

One end of the filament of the supplemental electrode 404 is connected to a lead 419, and is further connected to a connector 422 forming a pan of the adaptor 424, via a resistor 412 and a switch (or a properly oriented diode) 413. The lead 408 of the cathode 402 is connected to the connector 422, via a resistor 411 and the switch 413. The lead 407 of the anode 403 is connected directly to a connector point 423 of the adaptor 424.

The lamp 400 operates as follows: When an alternating voltage is applied between the connector 422 and the connector 423 (for instance, assume that the connector 423 is at a positive potential), the preparatory discharge is initiated between the electrode 403 and the supplemental electrode 404. With an increase of the voltage amplitude, the preparatory discharge spreads along the supplemental electrode 404 inside the tube 406, until it spreads between the electrodes 402 and 403. The main discharge is initiated between the electrodes 402 and 403. When the polarity of the power voltage is reversed, the switch 413 is switched OFF, and the device 400 does not operate.

Figure 16A:
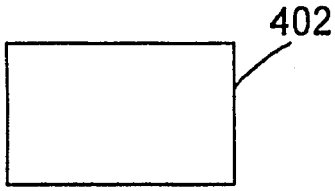
Figure 16B:
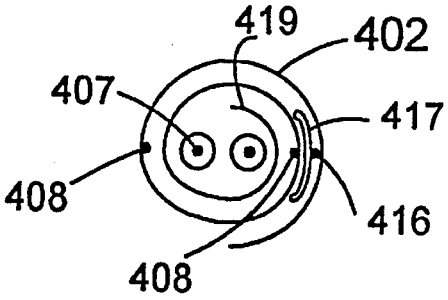

The device 400 is manufactured according to the following steps:

a leg 426 is formed with five leads and an exhaust tube 415 (FIG. 15);

the bulb 401 is formed;

the inner surface of the bulb 401 is coated with phosphor material;

the cathode 402 is formed in a helical flat shape (FIGS. 16A, 16B);

the anode 403 is formed as shown in FIG. 17;

the structural element (part) which is formed of the filament 404 extends along the longitudinal axis of the tube is made;

the dispenser 417 is connected to the lead 416 of the leg 426;

the part with the filament shown in FIG. 14 is assembled and attached, the end 421 (FIG. 14) of the supplemental electrode 404 is attached to the lead 409 of the leg 426;

the anode 403 is connected to the lead 420;

the bulb 401 is mounted on the leg 426;

if a low breakdown voltage is required, the bulb 401 is filled with a mixture of gases (Penning's mixtures), and the surfaces of the electrodes are oxidized;

the envelope 401 is then secured to the leg 426 by means of conventional methods, such as by welding;

the bulb 401 is connected to a vacuum pump (not shown) through the exhaust tube 415;

the bulb 401 is pumped out of air in accordance with conventional manufacturing methods of gas discharge devices;—the bulb 401 is filled with argon to a pressure of about 2–4 mm Hg, and is then disconnected from the pump;

connect a DC power supply with an adjustable output voltage of bout 200 to 600 V., with its positive terminal connected to the electrode 402, while its negative terminal is connected, via a resistor (R=3 kOhm, power consumption P=5 to 10 Watts) to the lead 416, a discharge occurs for about 40 minutes, with a current density of about 20 $mA/cm^2$;

the electrical circuit is connected to the corresponding leads such that they fit within the adaptor 424 which is secured to the bulb 401; and the assembled lamp is then connected to the power supply and burnt-in to its desired stabilization parameters.

The low pressure fluorescent mercury lamps described above, and illustrated in FIGS. 8 and 13 have been successfully tested, and can have the following characteristics and materials:

The total length of the bulb including the adaptor and base ranges between 120 mm and 180 mm;

the diameter of the adaptor ranges between 40 mm and 50 mm;

the length of the bulb working area ranges between 60 mm and 100 mm;

the materials and composition is as follows:

the bulbs 501, 511 are made of glass, example, lead or platinum group;

the main electrodes 502, 503 are made of carbon steel, annealed in hydrogen, and having a thickness of about 0.2–0.3 mm;

the supplemental electrode 504 is made of wire (carbon steel), annealed in hydrogen, and having a diameter of about 0.2–0.3 mm;

the leads and connections are made of a wire made of appropriate conducting material;

the dispenser is an enclosure made of solid material which, in the bound certain conditions vaporizes mercury;

any type of phosphor used with lamps (for illumination).

the gas can be, for example, argon at a pressure of about 2–4 mm Hg;

the power supply voltage can be, for instance, either 110 V, 127 V, 220 V or 380 V with other voltages being also contemplated by the present invention;

the components of the electrical circuit are as follows:

Resistor 411 (100–120 Ohms), and power consumption P (2.0–3.0 W); resistor 412 (1.0–1.5 kOhms), P (0.5–1.0 W); diodes 413, 414, allowed voltage $V_R$ not less than 400 V, and allowed current $I_F$ not less than 100 mA.

Figure 8:
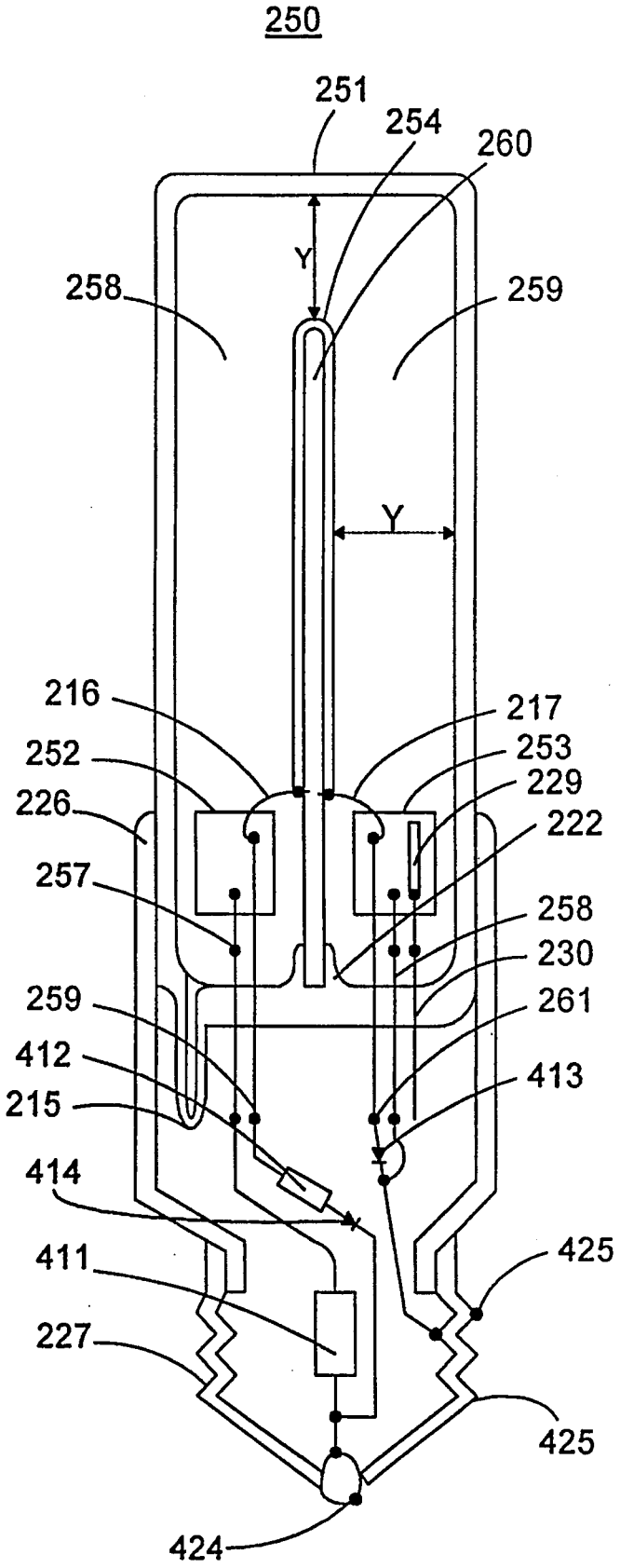
FIGS. 8 through 11B are schematic representations of still another embodiment of a gas discharge device according to the present invention.

The lamp shown on FIGS. 8 and 9 can be reduced in size significantly and can be used in car lamps, pocket flashlights, etc.

Figure 18:
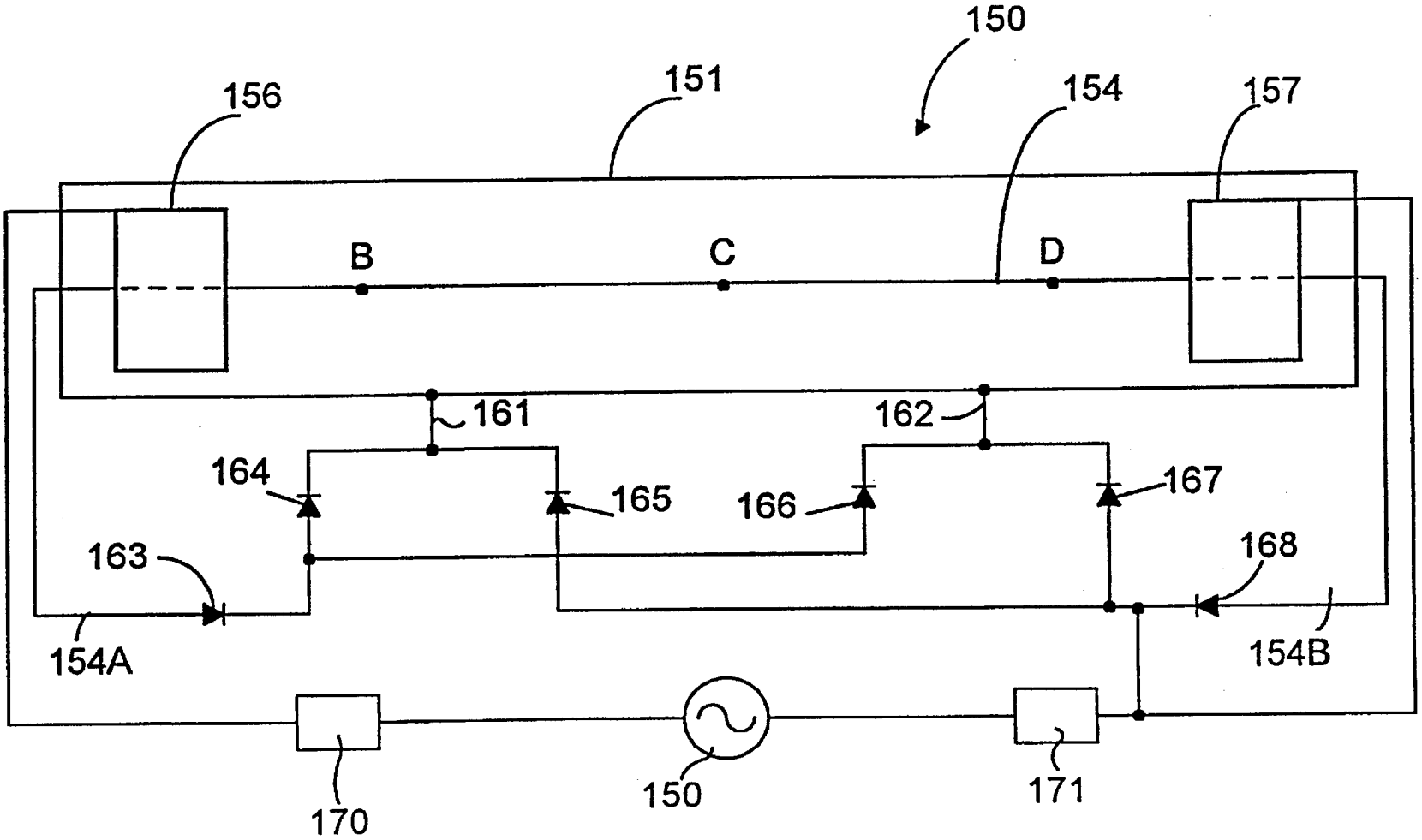
FIG. 18 is a schematic side elevational view of still another embodiment of a gas discharge device according to the present invention.

If the lamp working area is significantly long, it would be necessary to place one or more intermediate main electrodes (anodes and cathodes) inside the bulb, with ends located at specific points along the working length of the lamp. The mechanical design and schematic of such a "long" or "extended" low pressure fluorescent mercury lamp 150 is shown in FIG. 18.

The lamp 150 works as follows: When an AC voltage is applied, and for instance, the electrode 156 is at positive potential, the electrode 156 acts as an anode, while the other electrode 157 acts as a cathode. A supplemental electrode 154 acts as a preparatory discharge cathode. Two intermediate electrodes 161, 162 can be have different shapes, for example, rods, rings, grids, cylinders, etc., and act as preparatory discharge anodes. While only two intermediate electrodes 161, 162 are illustrated, it should become clear that a different number of intermediate electrodes can be used, depending on the desired length of the lamp 150.

The preparatory discharge is formed as follows: The discharge between the main anode 156 and the supplemental electrode 154 spreads along the filament forming the preparatory discharge, from the anode 156 to point B (its further spread is limited, for example, by the power supply voltage). The discharge between the intermediate anode 161 and the filament forming the preparatory electrode 154 spreads along the length B–C of the filament. The discharge between the intermediate anode 162 and the filament forming the preparatory electrode 154 takes place along the length C–D of the filament. At these conditions, the main discharge is initiated in the area between the main anode 156 and the main cathode 157, and causes the lamp 150 to operate.

When the polarity of the power supply changes all the processes in the lamp 150 develop in a similar way, but the main electrode 157 acts as an anode. The electrical circuit includes switches, for example, diodes 163, 168 which maintain the supplemental electrode 154 at a negative potential, and the remaining diodes 164, 165, 166 and 167 maintain the intermediate anodes 161, 162 at a positive potential during the lamp operation.

Another inventive method of effectively reducing the breakdown voltage will now be described for use mostly with long and capillary lamps. This inventive method includes the following steps: The gas-discharge lamp includes a bulb which is filled with a working substance and made from an optically transparent material which could be coated or not coated. The identical main electrodes (anode and cathode) and the supplemental electrode are placed in the bulb. The supplemental electrode includes two separated conducting sections that are formed, for example, as metal filaments. Each section of the supplemental electrode makes an electric connection with the main electrode or individual lead.

This design achieves the following results (FIGS. 19, 20, 24): a significantly reduced; increased life span; increased efficiency; enables the linear dimensions of the working area to be defined, i.e., size of the gas discharge distance; optimizes the lamp is supplied by an AC power supply. This technical result is achieved by a novel combination of the elements and conditions used in the invention.

Figure 19:
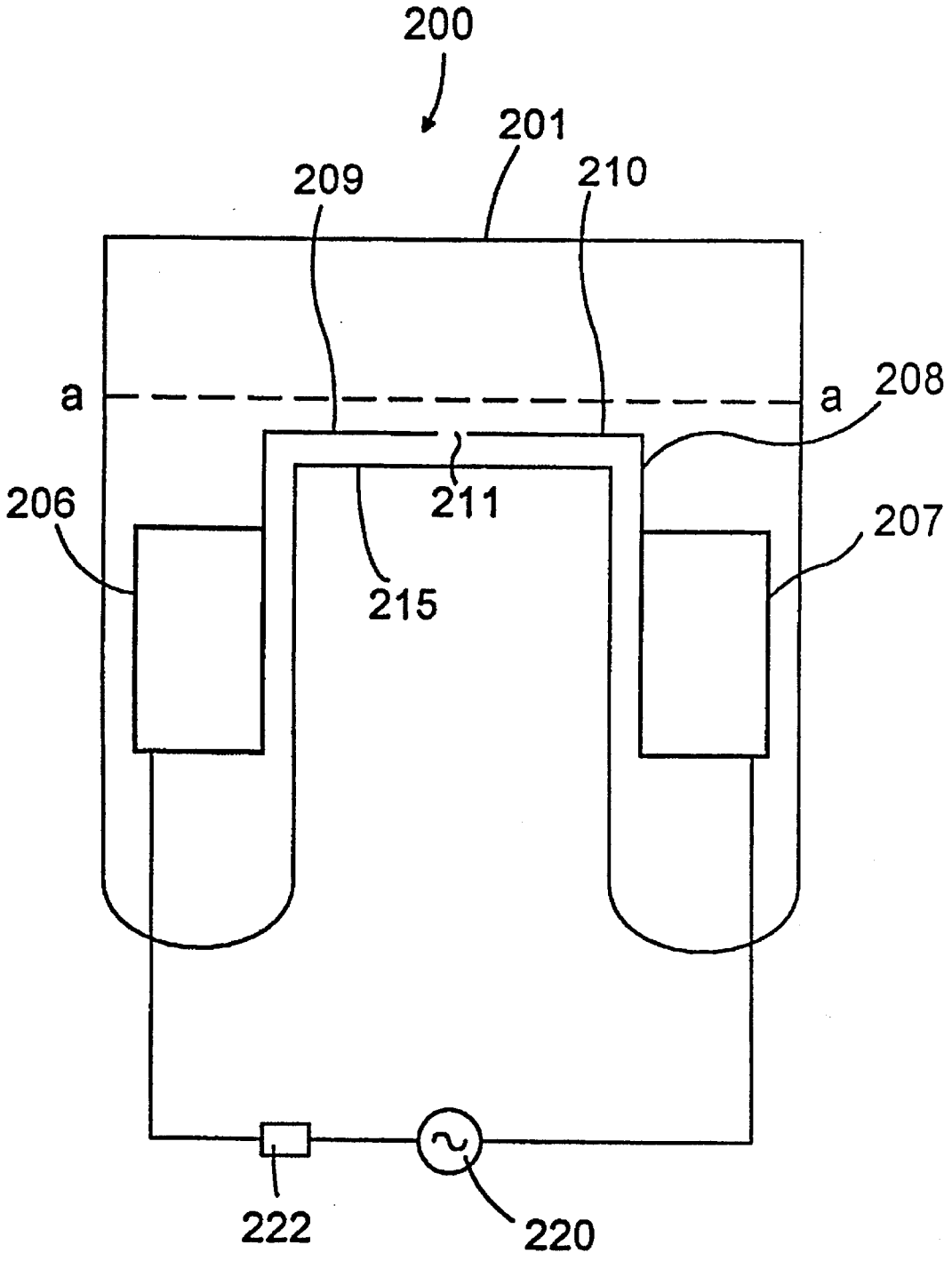
FIG. 19 is a schematic side elevational view of yet another embodiment of a gas discharge device according to the present invention.
Figure 20:
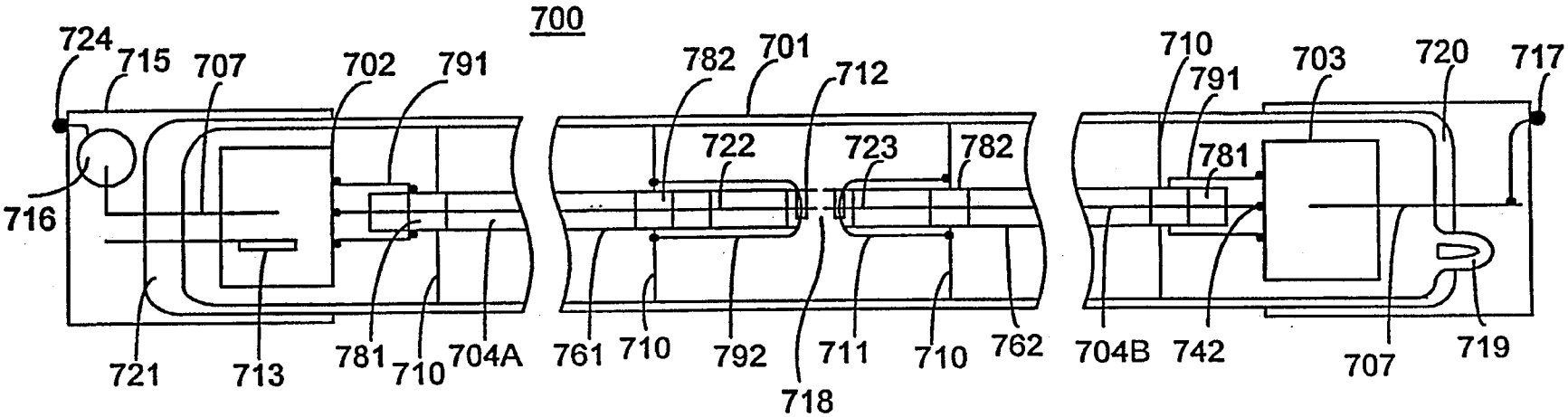
FIGS. 20 through 23 are schematic representations of a further embodiment of a gas discharge device according to the present invention.
Figure 22:
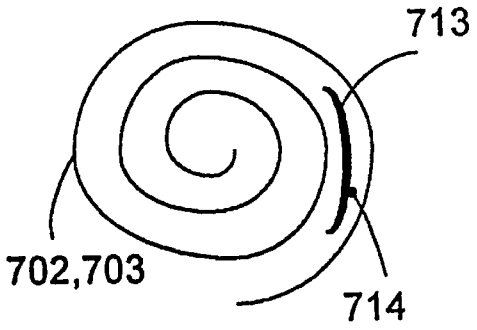
Figure 21:
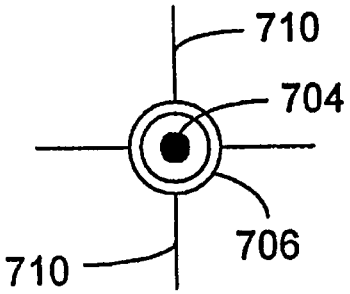
Figure 23:
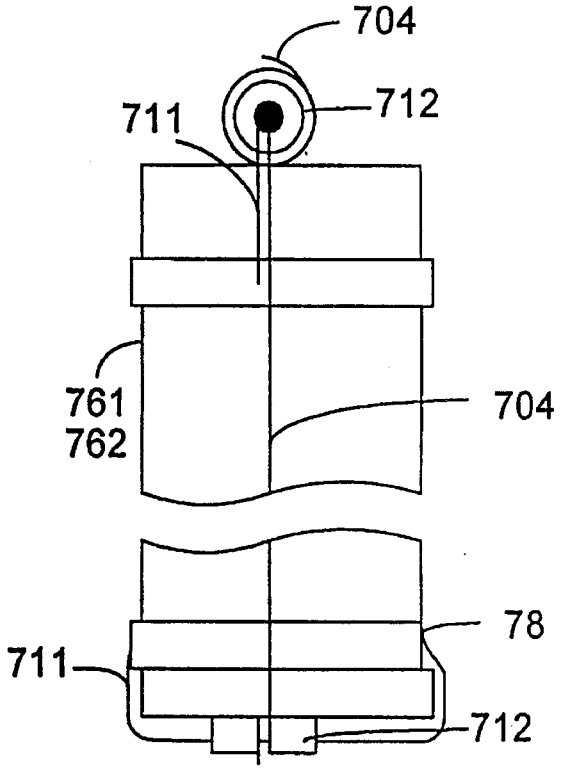

FIG. 19 illustrates another embodiment of a low pressure fluorescent mercury lamp 200, which is similar and design and construction to the lamp shown in FIG. 2, except for the configuration of the supplemental electrode 208 (FIG. 19), which includes two sections 209 and 210. The terminal ends of these sections 209 and 210 form a gap or clearance 211 therebetween, at about the middle of the envelope 201 (or discharge chamber).

The lamp 200 includes a bulb 201 which is filled with a working substance, and which is made of glass (or alternatively metal-glass). The surface of the bulb 201 is partially (working area) or completely coated with phosphor (alternatively, this surface is not coated). There are also possible different types of internal and external coatings, for example, lacquers, paints, different compositions that can include metals, and also glass treatment. The main electrodes 206 and 207, and the supplemental electrode 208 are placed and hermetically sealed within the bulb 201. The main electrodes 206, 207 are made, for example, as hollow cylinders.

The supplemental electrode 208 is made, for example, of a thin metal filament (metal strip or conductive coating). The supplemental electrode 208 extends through the gas discharge area and, as mentioned earlier, they include two (or more) sections 209, 210. Each section 209, 210 can have an individual lead or electrical contact with the main electrodes 206, 207 inside the bulb 201. The gap 211 between the sections 209, 210 of the supplemental electrode 208 can be made in such a way that the autoelectronic emission exists between the ends of the sections 209, 210, which enables the lamp 200 to be used indoors as well as outdoors at low ambient temperatures. In which case, the parameters of the gap 211 are chosen as function of the type and pressure of the working substance and composition of the supplemental electrode 208.

For illustration purpose, the sections 209, 210 of the supplemental electrode 208 are connected to the main electrodes 206, 207, and the electrical circuit includes the AC power supply 220, and resistor 222 for limiting the lamp current. It is noteworthy to mention that the supplemental electrode 208 can be placed in the narrow channel.

The lamp 200 works in the following way. When an AC voltage is connected (for example, the main electrode 206 is at a positive potential), the filament section 209 acts as an anode. The filament section 210 acts as a preparatory discharge cathode. The electrode 207 acts as the main cathode. The discharge starts between the anode 209 and the filament section 210 with a current $I_d$. The amplitude of the current $I_d$ depends on the electrical circuit parameters and the power supply of the lamp.

One condition for a reliable breakdown voltage in the gap 211 is that cathode area of the preparatory discharge must cover the entire surface of the filament section 210 in the area between the end of the section 210 closest to the gap 211 and the main electrode 207. When these conditions are met, the main discharge will ignite in the area between the end of the section 209 closest to the gap 211 and the main electrode 207. This discharge provides functionality of the right part of the lamp and its lighting characteristics. The part of the lamp from gap 211 to the cathode 207 emits light energy. When the polarity of input voltage is reversed, all the steps in the lamp 200 develop in a similar way as described above. However, the filament section 210 acts as an anode, the filament section 209 acts as the preparatory discharge cathode, and the electrode 206 acts as the main cathode. When these conditions are met, the main discharge will ignite in the area between the end of the section 210 closest to the gap 211 and to the main electrode 206. This discharge provides functionality of the right part of the bulb and its lighting characteristics.

The alternate function of the left and right parts of the lamp 200 takes place at half with half the frequency of the power supply voltage. For example for domestic or industrial line frequencies, the operation of the lamp 200 appears to be continuous.

The capillary lamp works according to similar principles, such that the gap 211 between the filament sections is placed inside a canal or conduit (limited by the broken line a—a and the line 215) having a small diameter. The main electrodes 206, 207 are placed in corresponding sections of the bulb 201 having a larger dimensions than the canal. The method of operation, design, schematic diagram and functionality of the capillary lamp are the same as for the lamp 200. The processes in the narrow canal of the capillary lamp, stipulated by the presence of a filament with gap in this canal, allow to develop canals of arbitrary configuration and dimensions, for example, as helixes, rings, signs, symbols, etc.

FIGS. 20 through 23 illustrate another embodiment of a low breakdown voltage gas discharge device 700. In this particular example, and for illustration purpose, the device 700 is used as a low pressure fluorescent mercury lamp with a long bulb. The device has been developed according to the present invention, and it is particularly distinguishable in that it includes a minimal number of electrical components.

The lamp 700 includes a bulb 701, the inner surface of which is coated with phosphor. The bulb 701 is hermetically sealed, and contains two identical main electrodes 702 and 703, which are generally helically shaped. A supplemental electrode 704 is made of two sections 704A and 704B, and is made of a conductive or metallic filament which extends along the axial direction of the bulb 701. The first section 704A extends from a filament end 722 to another end 741, and the second section 704B extends from a filament end 723 to another end 742.

A clearance or gap 718 is formed between the ends 722 and 723 of the filament 704. The clearance 718 is disposed about the middle section of the lamp working part. The ends 741 and 742 are electrically connected directly to the electrodes 702 and 703. The filament sections 704A and 704B are axially disposed inside glass tubes 761 and 762. A plurality of cross bars or spacers 710 and wire arms or wire brackets 791 hold the tubes or conduits 761 and 762. One end of the arm 791 is fixed to the clip 781, located on the glass tube 761, and the other end is connected to the main electrode.

A mercury dispenser 713 is located in the electrode 702, and terminates in a lead. The filament ends 722 and 723 forming the clearance 718, are fixed to the external surface of a small diameter ceramic cylinder 712. A wire 711 passes through the cylinder 712 and has its ends fixed to the clip 782. Each end of the bulb 701 is supported by a fixture or adaptor 715, one of which contains an active resistor 716 connected to a lead 724. At the opposite end, the fixture 715 is connected to a lead 717.

When an alternating voltage is applied to the lead 724 (for instance, at a positive half-period) and to the lead 717, the preparatory discharge will ignite in the clearance 718 between the filament ends 722 and 723, and the filament end 722 acts as the main anode. With an increase in the supply voltage amplitude, the preparatory discharge spreads along the filament section 704B, inside the tube 762, and will cover the discharge chamber between the filament end 722 and the electrode 703. The main discharge will start in the entire discharge chamber between the filament end 722 and the electrode 703, while does not ignite in the other side of the bulb 701 and thus does not consume energy.

When the polarity of the supply voltage is reversed, a similar but reverse process will take place in both halves of the discharge chamber, and the discharge starts in the section of the discharge chamber housing the filament section 704A, while it is does not start in the other section, and thus does not consume energy.

Such alternate operation of the lamp 700 occurs at half the frequency of the supply voltage; and, at the frequencies of the domestic and industrial power supplies, the operation of the lamp 700 is, in general, perceived as being continuous. The present design of the lamp 700 can double the effective length of the discharge chamber, without changing the supply voltage.

The materials used to manufacture the lamp 700 are as follows:

the bulbs 701 is made of glass, for example lead or platinum group;

the main electrodes are made of carbon steel, annealed in hydrogen, and having a thickness of about 0.2–0.3 mm;

the supplemental electrode is made of wire (carbon steel), annealed in hydrogen, and having a diameter of about 0.2–0.3 mm;

the leads and connections are made of a wire made of an appropriate conducting material;

the dispenser is an enclosure made of solid material, which, in certain conditons vaporizes mercury;

any type of phosphor material used with lamps (for illumination).

the gas can be, for example, argon at a pressure of about 2–4 mm Hg;

the power supply voltage can be, for instance, 220 V or 380 V AC with other voltages being also contemplated by the present invention;

the components of the electrical circuit are as follows:

Resistor 716 (100–120 Ohms), power consumption P=2.0–3.0 W.

The overall dimensions of the lamp 700 are as follows: The total length including the adaptor is about 650 mm; the diameter of the bulb 701 is about 40 mm. The gas discharge device 700 can be modified to increase its life span, by reducing the filament sputtering caused by the random increase of the power supply voltage, as illustrated in FIG. 24.

Figure 24:
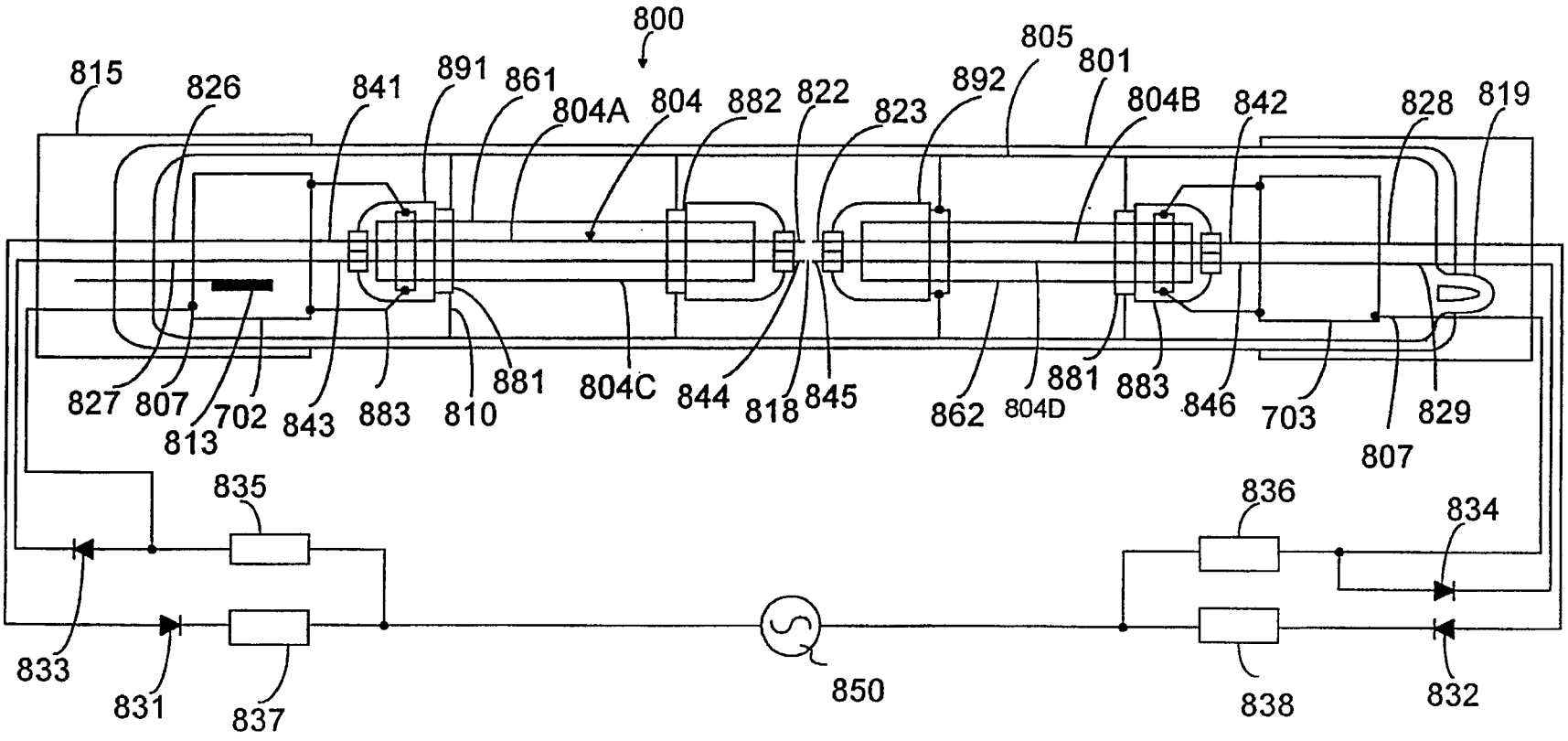
FIG. 24 is a schematic side elevational view of another embodiment of a gas discharge device according to the present invention.

FIG. 24 illustrates yet another embodiment of a low pressure fluorescent mercury lamp 800, which is constructed according to the present invention. In the present exemplary application, the device 800 is used as a lamp, and it is generally similar in construction to the lamp 700 of FIG. 20, except that the supplemental electrode 804 of the lamp 800 includes four sections 804A, 804B, 804C and 804D.

The filament section 804A is generally similar to the filament section 704A of the lamp 700, and extends axially, between filament ends 841 and 822. The filament section 804B is generally similar to the filament section 704B of the lamp 700, and extends axially, between filament ends 823 and 842. The filament section 804C is generally similar, and extends axially, in parallel to the filament section 804A, between filament ends 843 and 844. The filament section 804D is generally similar, and extends axially, in parallel to the filament section 804B, between filament ends 845 and 846.

The filament section 804A extends outwardly in a lead 826. Similarly, the filament section 804C extends outwardly in a lead 827. The filament section 804B extends outwardly in a lead 828, and the filament section 804D extends outwardly in a lead 829. The following electrical components can be incorporated as part of the lamp 800, or, alternatively, they can form a separate circuit to be connected to the lamp 800 at the time of use.

The electric circuit includes ballast resistors 835 and 836, for limiting the current in the lamp 800. Resistors 837 and 838 limit the currents in the supplemental electrodes. The switches or diodes 831, 832, 833 and 834 supply power to the supplemental electrodes.

The lamp 800 operates as follows: When an alternating voltage from a power source 850 is applied to the lamp 800 (for instance, the left side is at a positive potential) the filament section 804C acts as an anode, the filament section 804B acts as a preparatory discharge cathode (there is no voltage across the filament sections 804A and 804D, because of the orientation of the diodes or switches 831 and 834).

The preparatory discharge starts in the gas chamber between the filament section 804B and the electrode 703, and the main discharge then starts in the area between the filament end 844 and the electrode 703, which provides the operation (illumination) of the right side of the lamp 800 and its lighting characteristics. When the polarity of the supply voltage is reversed, the above process in the lamp is repeated, but the filament section 804A acts as a preparatory discharge cathode, and the filament section 804D acts as an anode (there is no voltage across the filament sections 804B and 804C because of the orientation of the diodes 832 and 833), and the electrode 702 acts as the cathode for the main discharge. Under such conditions, the main discharge is initiated in the discharge chamber between the filament end 823 and the electrode 702, which ensures the operation (illumination) of the left side of the lamp 800 and its lighting charateristics.

The reduction of the filament sputtering is achieved by means of resistors having high resistance values (i.e., 1.5 kOhm to 2.0 kOhms).

Figure 25:
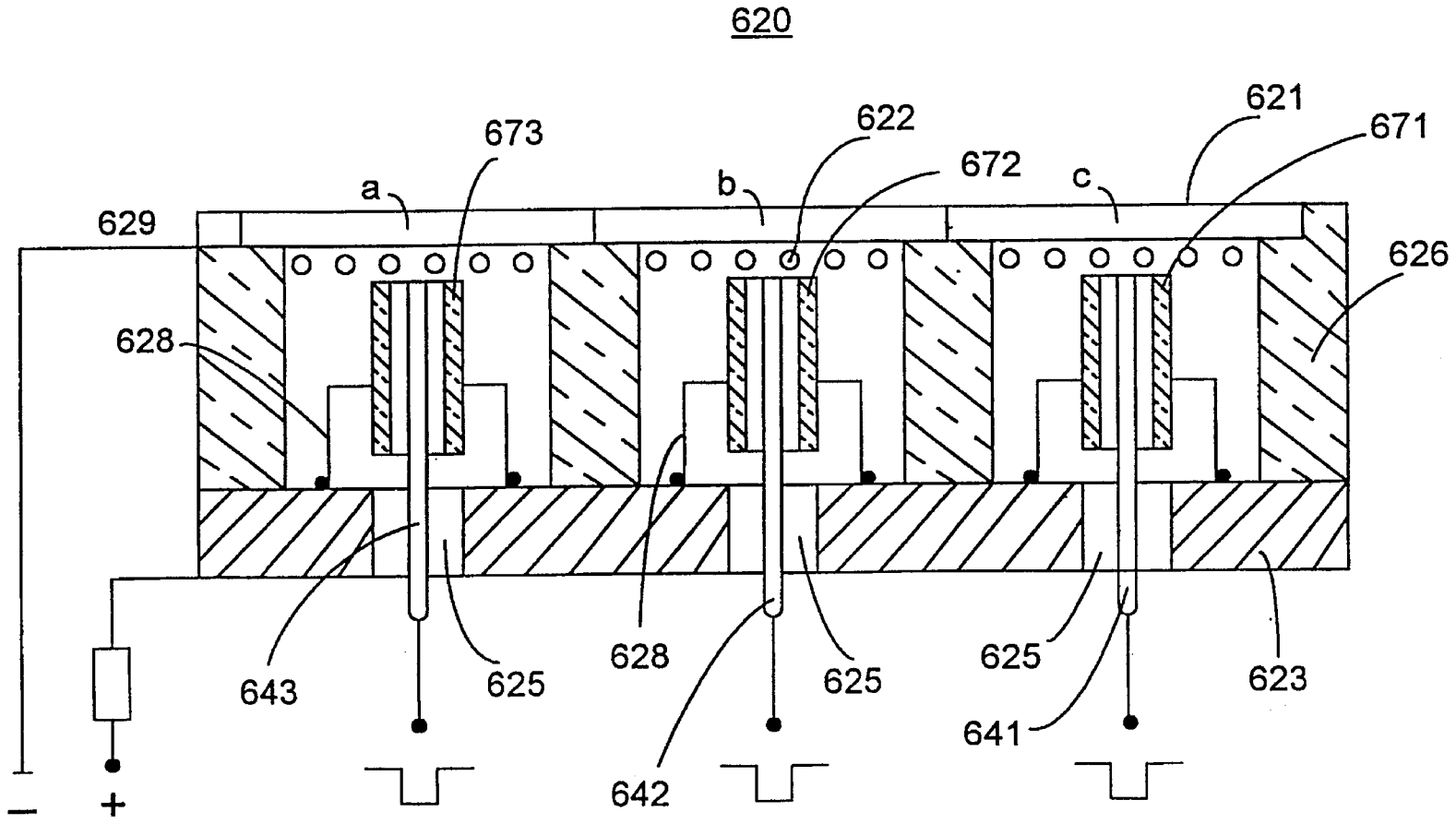
FIG. 25 is a schematic side elevational view of a further embodiment of a gas discharge device according to the present invention.

FIG. 25 still another embodiment of a gas discharge device 620 in accordance with the present invention. In the present illustrated application, the device 620 is used as a lamp, and includes a glass-metal-ceramic bulb 621, and a conductive cathode 623 (bottom) which retains a plurality of electrodes, such as 641, 642 and 643, via a plurality of glass (or insulation) bases 625.

The electrodes 641, 642 and 643 are made as sections of a relatively thick wire, the geometric dimensions of which are defined by Equation [1] above. The electrodes 641, 642 and 643 are located inside corresponding short glass tubes, 671, 672 and 673, respectively, which are secured to the cathode 623 by means of metal brackets 628. An anode 622 is configured as a grid and terminates in a lead 629.

One or more glass covers a, b, and c are coated with phosphors of the same or different radiation colors, such as red, blue and green. Each cover (a, b, c) forms a separate lamp which is capable of operating independently, as described above in relation to the lamp 400 in FIG. 13. It should however be understood to those skilled in the art that, while the device 620 is illustrated as being formed of three independent lamps, an additional number of lamps can alternatively be used without departing from the scope and concept of the present invention. The lamp sections (a, b, c) operate when negative pulses are applied to the electrodes 641, 642 and 643. The shape and dimensions of the lamp 620 vary with the application of the device 620.

The bulbs of the present gas discharge light devices described herein are made of glass, glass-ceramic or metal-ceramic. These bulbs are filled with appropriate gases, metal vapors mixtures thereof, depending on the nature of the application of the devices. The electrodes can assume various shapes, such as pins, hollow cylinders, flat helixes, etc. The electrodes used as cathode have a maximum surface area, since the glow discharge current mode of normal cathode potential fall increases with the cathode surface area. The cathodes are oxidized in order to reduce the breakdown voltage, and the gas mixtures are used. In order to reduce the breakdown voltage, either Penning's mixtures or oxidized electrodes or a combination of both are used.

All the main electrodes that function as a cathode need to have insulated enclosures or coatings. These enclosures or coatings are necessary to protect the bulb and other parts from the deposition of the sputtered cathode material. Isolating enclosures (metallic or isolating material) can be shaped, for example, as grids, blanks, or repeat configuration of cathode bases.

In designing the lamps, all the parts and working substance located inside the lamp bulb which, in the sputtered state create amalgams with mercury are not used.

In designing prototypes for these lamps, all the electrodes other than the anodes were made of steel annealed in hydrogen, and the bulbs were filled with argon at a pressure of about 2–4 mm Hg. The mercury vapors were created by means of the mercury dispenser which functioned as a cathode (when the lamp was manufactured) and at least one of the main electrodes was anode. Before that the working substance was free of mercury vapors. The mercury dispenser is connected as cathode to provide a current density of about 20 mA/cm$^2$. In the preferred design, flat helically shaped electrodes were used, as they provide a large working surface. The idea being that is that a flat helically shaped electrodes does not occupy too much room but has a significant surface area and can be easily manufactured.

Figure 27:
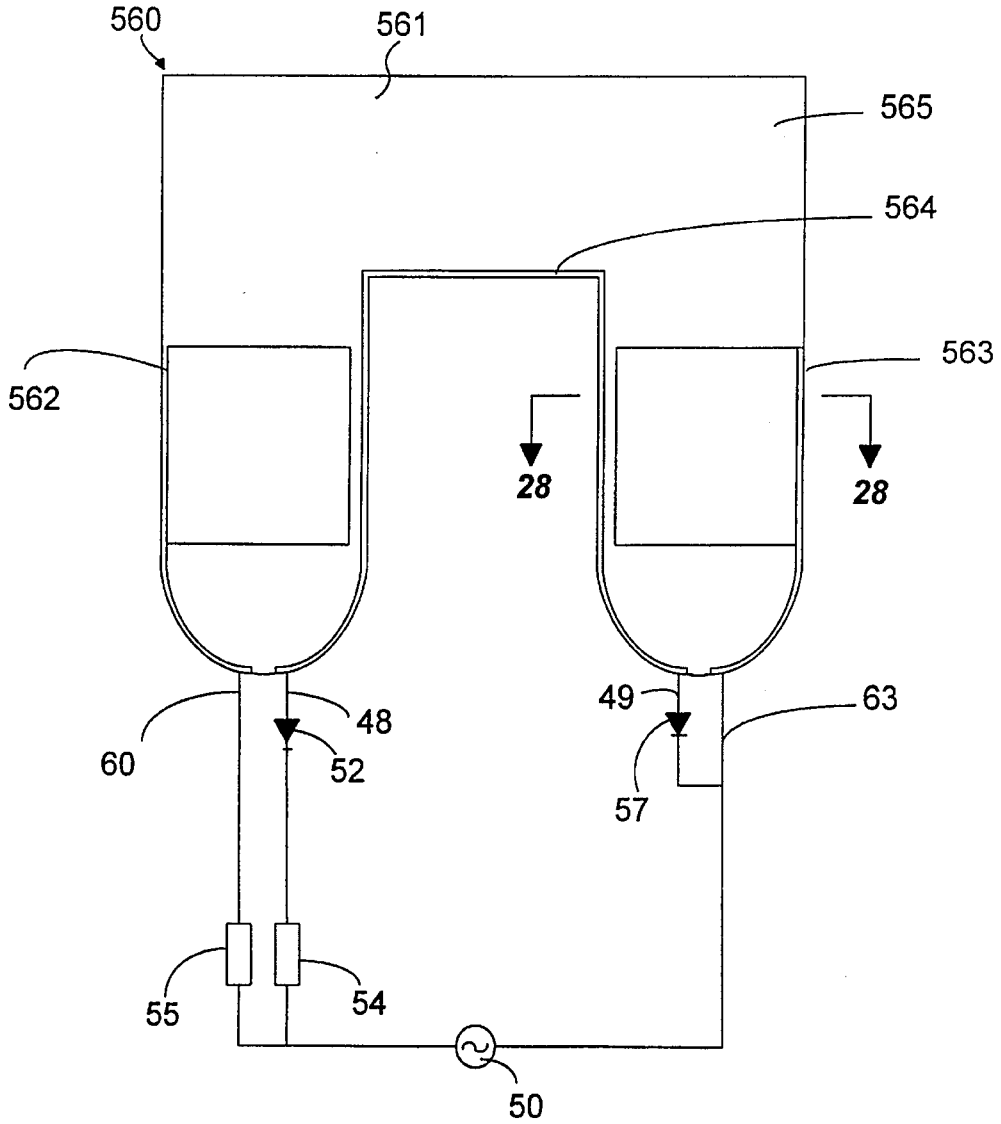
FIG. 27 is a schematic side elevational view of another embodiment of a gas discharge device according to the present invention.
Figure 28:
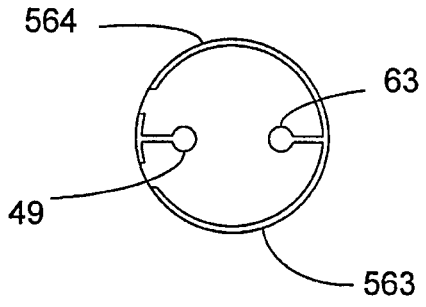
FIG. 28 is a schematic cross-sectional view of a part of the gas discharge device of FIG. 27, taken along line 28—28 thereof.

Additionally, the main and supplemental electrodes, connections and leads can be made by depositing an electroconductive material on the inside surface such as by sputtering, coating, changing the chemical composition of the bulb material, etc. The filament can be made as a filament or wire (steel annealed in hydrogen), or, alternatively, it can be a conductive material which is deposited, for example, by sputtering, coating, changing the chemical composition of bulb material, etc., on an insulating substrate, such as the bulb, as illustrated in FIG. 27.

The mechanical parameters of the filament (length, diameter, width, material) are selected such that they satisfy Equation [1] above. The mechanical parameters of the filament play an important role in the operation of the lamp. It would be desirable to use materials with a low value of sputtering coefficient and constant C (refer to Equation [1] above). By properly selecting the surface area of the filament, it would be possible to control the breakdown voltage and consequently the power consumption and energy of the lamp. For example, if the surface area of the supplemental electrode were relatively large, then for the preparatory discharge to spread, it will require a relatively large voltage on the filament during the power supply voltage increase. This causes late ignition of the lamp and reduction of its working period because the extinction voltage is always the same. As used herein, the working period refers to the duration of the main discharge, which is the difference between the time of ignition and the time of extinction. Constant "C" is determined empirically. This constant can be used to control the quality if the materials for lamp manufacture.

If a coded signal were applied to the supplemental electrode (i.e., different duration pulse sequence, the pulse width must be much longer than the power supply voltage period) the lamp will emit light energy according to the coding signal.

When ignition is staffed by preparatory discharge on the supplemental electrode, then a relatively low breakdown voltage is required. For this reason, glow discharge transients generated by the (of a glow gas discharge) in the lamp practically do not generate noise or radio interference, and further the lamp has higher useful life span because glow discharge does not cause intensive cathode destruction or deterioration.

If the distance between the supplemental electrode end and the main electrode (anode) is small and the potential gradient near the supplemental electrode is high (the discharge type: point—plane) the discharge between the supplemental electrode and the electrode ignites practically instantaneously at the same power supply voltage. The main discharge breakdown voltage is also practically stable, since stable gas ionization in the main area (i.e., an area between the main anode and cathode) is determined by the preparatory discharge with stable parameters.

In order to reduce the stroboscopic effect (flickering), it would be necessary to optimally select the lamp geometrical dimensions of the lamp and the supplemental electrode, and composition of the main electrodes in order to provide the fastest ignition.

Figure 26:
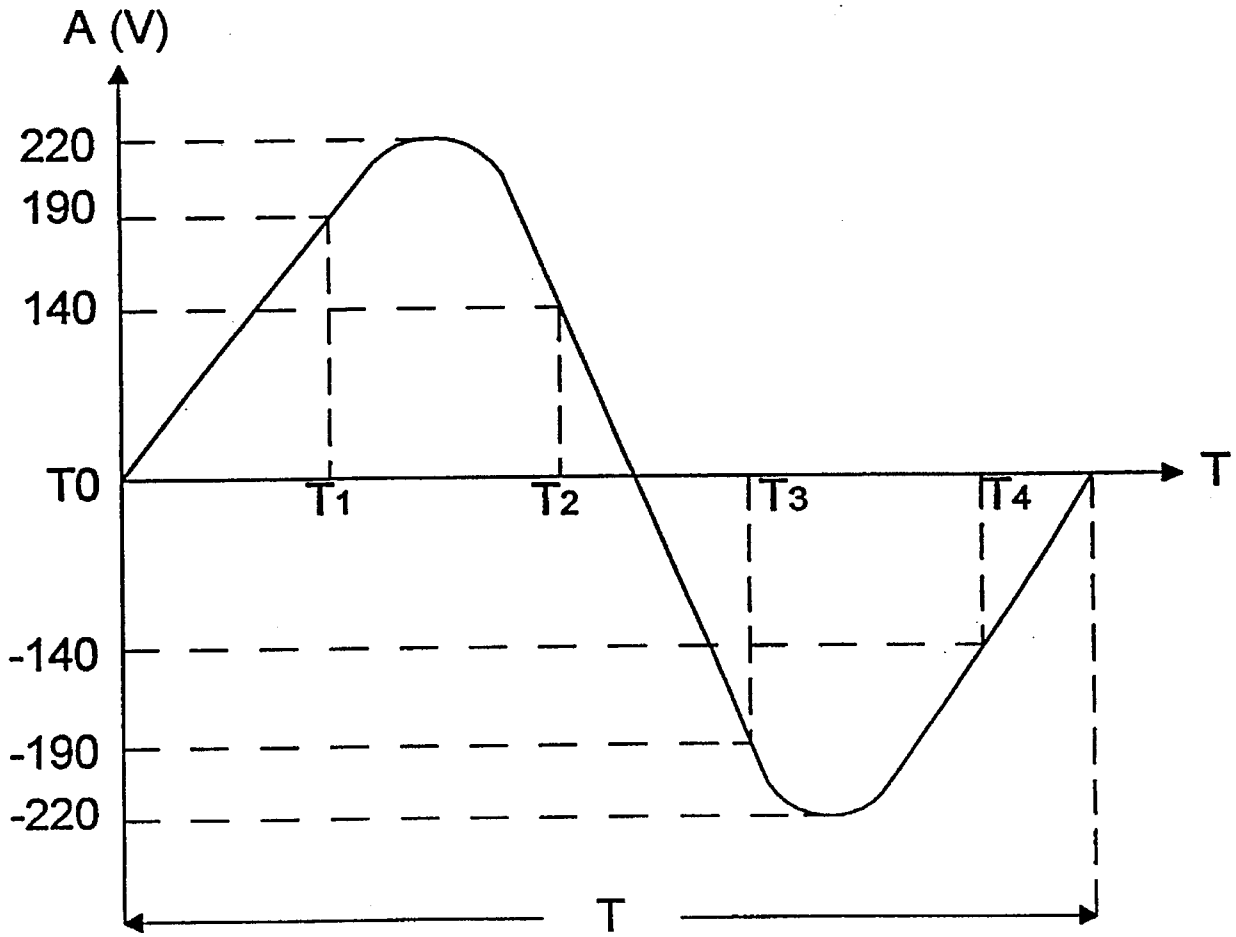
FIG. 26 is a time graph illustrating the cyclical operation of the gas discharge device of FIG. 2.

The timing characteristics of the gas discharge devices according to the present invention are shown in the timing diagram illustrated in FIG. 26, over one period of the input AC voltage amplitude (A). The amplitude of the input voltage changes as follows:

$$A=Ao\times Cos(2\times\pi\times F\times T)$$

where "F" is the frequency. For example, if Ao=220 V and f=50 HZ, when voltage changes from A=0 V to A=190 V the lamp breakdown takes place for time $(T_1-T_0)$=4.318 ms from the start of cycle). In the voltage interval A=190–220–140 V the lamp fires (it corresponds the timing interval $(T_2-T_1)$=2.49 ms), then it is turned off and again it ignites after a time interval $(T_3-T_2)$=7.49 ms, and fires during $(T_4-T_3)$ and then is turned off, and the cycle is repeated. In general, the lamp fires about 30% of the time. This is comparable to the ignition time of traditional lamps. The firing time is taken into account in all designs.

The following is a comparative analysis of the features and advantages of the present gas discharge devices relative to conventional gas discharge devices:

| CONVENTIONAL GAS DISCHARGE DEVICES | PRESENT GAS DISCHARGE DEVICES |
|---|---|
| 1. Arc discharge is used. | 1. Glow discharge is used |
| 2. Incandescent cathode. | 2. Cold cathode |
| 3. High breakdown voltage | 3. Low breakdown voltage |
| 4. Relatively unstable breakdown voltage; high power supply voltage is required. | 4. The breakdown voltage is stable. |
| 5. The geometric dimensions can not be optimized by the breakdown voltage. | 5. The geometric dimensions are optimized by the breakdown voltage. |
| 6. Ignition is not controllable. | 6. Ignition is controllable. |
| 7. Special ballasts are used. | 7. No special ballasts are used or required. |
| 8. In most devices, the power consumption is equal to, or exceeds 7 W. | 8. The power consumption can be around 1–7 W. |
| 9. Flickering takes place and stroboscopic effect is possible. | 9. It is possible to use DC power supply. In this case there is no flickering nor stroboscopic effect. |
| 10. The instantaneous lamp ignition is provided by special means. | 10. The lamp ignites instantaneously without additional special means. |
| 11. The signal coding is impossible. | 11. The signal coding is possible. |
| 12. Can be a source of radio interference. | 12. The radio interference level is significantly reduced. |
| 13. The life is limited by number of ignitions (as a result of destruction cathode oxide layer). | 13. The number of ignitions does not affect the life of the devices. |
| 14. Scarce materials are used for manufacturing the devices (tungsten, nickel). | 14. Scarce materials are not used for manufacturing the devices. |
| 15. The main applications are for residential and commercial lighting (other applications are not reasonable due to the power consumption and lack of control). | 15. Used for lighting and special lighting (emergency and duty), lighting of staircases, elevators, basements and etc., light panels, advertisement). |
| 16. The ballasts generate harmonic distortions, adversely affecting the quality of the power supply. | 16. When reactive ballasts are not used, harmonic distortions are not generated. |

It is noteworthy to point out that the foregoing brief description of the major design features based on the proposed development principles of the gas discharge light devices, shows just a small part of wide variety of possible and contemplated technical solutions. It would be quite possible to combine the proposed development principles herein explained with principles used in existing light sources, independent of: discharge type (glow, arc, spark or with hollow cathode); cathode type (cold, hollow, incandescent); type of working substance (gases, vapors, or mixtures thereof); working substance pressure; bulb design (shape and configuration, dimensions, materials, coating and treatment); types of power supply voltage (DC, AC, pulsating, pulse, high frequency); ballast types or current limiting resistors, it is possible to get a wide spectrum of devices depending on the desired application: reduced breakdown voltage, optimal by ignition conditions mechanical characteristics of the lamp working area, capability to control the energy of light emission, stable breakdown voltage, reduced level of noise and radio interference, higher efficiency, energy saving and reduced cost.

VIII. High Pressure Fluorescent Mercury Lamps

A high pressure fluorescent mercury lamp according to the present invention includes a bulb made of thermoresistive glass. Inside the bulb there is mounted a high pressure mercury-quartz lamp. The main electrodes and supplemental electrode are made of conductive material and are located inside the mercury-quartz lamp. The supplemental electrode satisfies Equation [1] above. The supplemental electrode extends between the main electrodes co-directionally with the electric discharge axis. The inside of the bulb surface is coated with thermoresistive phosphor.

IX. Bactericidal Lamps

A bactericidal lamp according to the present invention generally includes a cylinder bulb made of quartz or UV transparent glass with high ultraviolet light transmission, and is filled with argon and mercury vapors. The main and supplemental electrodes are welded to the lamp bulb. The supplemental electrode satisfies Equation [1] above. The supplemental electrode extends between the main electrodes co-directionally with the –electric discharge axis.

X. Eritem Lamps

An eritem lamp according to the present invention generally includes a cylindrical bulb made of special quartz or UV transparent glass with high ultraviolet light transmission, and is filled with argon and mercury vapors. The main and supplemental electrodes are welded to the lamp bulb. The supplemental electrode satisfies Equation [1] above. The supplemental electrode extends between the main electrodes co-directionally with the electric discharge axis XI. High Pressure Mercury Lamps A high pressure mercury lamp according to the present invention generally includes a bulb made of thermoresistive glass with a gas-discharge tube filled with argon and mercury and joined to the bulb leg inside the bulb. The bulb is pumped out to a high vacuum. The main electrodes and supplemental electrode are made of an electroconductive material, and are connected to both end faces of gas-discharge tube. The supplemental electrode satisfies Equation [1] above. The supplemental electrode extends between the main electrodes co-directionally with the electric discharge axis.

XII. High Pressure Mercury-quartz Lamp

A high pressure mercury-quartz lamp according to the present invention has a low breakdown voltage, does not require special ballasts, has a stable ignition mode and a relatively high efficiency. It generally includes a quartz tube filled with argon and mercury. The main electrodes and the supplemental electrode, are made of electroconductive material, and are connected to both end faces of the gas-discharge tube. The supplemental electrode satisfies Equation [1] above. The supplemental electrode extends between the main electrodes co-directionally with the electric discharge axis.

XIII. Super High Pressure Mercury-quartz Lamps

A super high pressure mercury lamp according to the present invention has a low breakdown voltage, does not require special ballasts, has a stable ignition mode and a relatively high efficiency. It generally includes a spherical bulb made of quartz and filled with a dosed amount of mercury. The main electrodes and supplemental electrode, are made of an electroconductive material, and are connected to both end faces of the bulb. The supplemental electrode satisfies Equation [1] above. The supplemental electrode extends between the main electrodes co-directionally with the –electric discharge axis.

XIV. Super High Pressure Gas Lamps

A super high pressure gas lamp according to the present invention has a low breakdown voltage, has a stable ignition mode and a relatively high efficiency. It generally includes bulb made, for example, of quartz filled, for example, with xenon. The main electrodes and the supplemental electrode, are made of electroconductive material, and are connected to the bulb. The supplemental electrode satisfies Equation [1] above. The supplemental electrode extends between the main electrodes co-directionally with the –electric discharge axis.

XV. Low Pressure Sodium Lamps

A low pressure sodium lamp according to the present invention has a low breakdown voltage, has a short stabilization time or electric and light characteristics, does not require special ballasts, and a relatively high efficiency. It generally includes a bulb made of special glass resistive to sodium vapors. The bulb is filled with a dosed amount of pure metallic sodium and a small amount of inert gas, for example, neon, helium or argon. The main electrodes and supplemental electrode are made of electroconductive material, and are connected to the bulb. The supplemental electrode satisfies Equation [1] above. The supplemental electrode extends between the main electrodes co-directionally with the electric discharge axis.

XVI. Spectral Lamps

A spectral lamp according to the present invention has a low breakdown voltage, does not require special ballasts, has a short stabilization time of electric and light characteristics, and a relatively high efficiency. It generally includes a bulb made of regular or glass with gas-discharge tube attached inside. The bulb is filled with a working substance such as argon and metal vapors: mercury, zinc, cadmium, thallium, sodium or cesium. Depending on working substance used, the tubes are made of quartz or special glass. The main electrodes and supplemental electrode, are made of electroconductive material, and are connected to the bulb. The supplemental electrode satisfies Equation [1] above. The supplemental electrode extends between the main electrodes co-directionally with the electric discharge axis.

While specific embodiments of the gas discharge device have been illustrated and described, in accordance with the present invention, modifications and changes of the apparatus, parameters, materials, methods of manufacture, etc. will become apparent to those skilled in the art, without departing from the scope of the invention.

What is claimed is:

1. A low breakdown voltage gas discharge device comprising in combination:

a. an envelope filled with a discharge medium;

b. two main electrodes hermetically sealed in said envelope and separated by a predetermined distance and defining a direction for an electrical discharge;

c. a supplemental electrode extending at least partially between said main electrodes along said direction of the electrical discharge; and d. said supplemental electrode having geometrical and electrical parameters satisfying the following equation:

$$S=I_d/C,$$

where S is the surface area of said supplemental electrode and depends on said distance between said main electrodes, $I_d$ is the current flowing in said supplemental electrode during normal glow discharge, and C is a constant characterizing said current $I_d$, the composition of said supplemental electrode, and the type and pressure of said discharge medium.

2. The device according to claim 1, wherein each of said main electrodes and supplemental electrode includes at least one output lead.

3. The device according to claim 1, wherein said supplemental electrode is connected to a power source via a switch, for causing said supplemental electrode to act as a preparatory cathode.

4. The device according to claim 1, wherein each of said main electrodes terminates in a corresponding output lead extending outside said envelope;

wherein said supplemental electrode terminates in two leads extending outside said envelope; and wherein said main electrodes leads and said supplemental electrode leads are connected to a voltage for connection to a power source.

5. The device according to claim 1, wherein said envelope is coated with an appropriate coating, made of luminophor, lacquer, or paint.

6. The device according to claim 1, wherein said envelope is generally cylindrically shaped.

7. The device according to claim 1, wherein said envelope is generally U-shaped.

8. The device according to claim 1, wherein said envelope is arcuately shaped.

9. The device according to claim 1, wherein said main electrodes are spirally-shaped.

10. The device according to claim 1, wherein said main electrodes are cylindrically shaped.

11. The device according to claim 1, wherein said discharge medium is gas-argon under a pressure ranging between 200 Pa and 700 Pa.

12. The device according to claim 1, wherein said supplemental electrode is shaped as a filament and is made of carbon steel annealed in hydrogen.

13. The device according to claim 1, wherein said envelope has an extended length; and further includes at least one additional intermediate electrode disposed between said main electrodes.

14. The device according to claim 1, wherein said main electrodes are identical.

15. The device according to claim 1, wherein said supplemental electrode includes a plurality of sections; and wherein two adjacent sections of said plurality of sections form a clearance therebetween.

16. The device according to claim 1, wherein said main electrodes and said supplemental electrode are connected to an alternating (AC) power source; and wherein said supplemental electrode remains at a negative potential.

17. The device according to claim 16, wherein the surface area S of said supplemental electrode is defined by the following equation:

$$S=\Pi\times D\times L,$$

where D is the diameter of said supplemental electrode, and L is equal to said separation distance between said main electrodes.

18. The device according to claim 1, wherein said discharge medium includes a gaseous substance.

19. The device according to claim 1, wherein said discharge medium includes vacuum.

20. The device according to claim 1, wherein said discharge medium includes metal vapors.

21. The device according to claim 1, wherein said discharge medium is contained, under low pressure within said envelope.

22. The device according to claim 1, wherein said envelope is made from optically transparent material.

23. The device according to claim 1, wherein said envelope is made of a ceramic, metallic or glass material.

24. The device according to claim 1, wherein said supplemental electrode is formed on said envelope.

25. The device according to claim 1, wherein said supplemental electrode is formed on said envelope.

26. The device according to claim 1 for connection to an external load, and for maintaining a generally constant potential across said external load.

27. The device according to claim 1 for connection across an external load, and for maintaining a generally constant current flowing through said external load.

28. The device according to claim 1 for generating random aperiodic oscillations.

29. The device according to claim 1, wherein said constant C is empirically determined, and characterizes said current $I_d$, the composition of said supplemental electrode, and the type and pressure of said discharge medium.

30. The device according to claim 29, wherein the current density in said supplemental electrode is substantially constant.

* * * * *